US011556090B2

(12) United States Patent
Sato

(10) Patent No.: US 11,556,090 B2
(45) Date of Patent: Jan. 17, 2023

(54) IMAGE FORMING APPARATUS INCLUDING DRAWER AND DRUM UNIT ATTACHABLE TO DRAWER AND HAVING FIRST PHOTOSENSITIVE DRUM AND SECOND PHOTOSENSITIVE DRUM

(71) Applicant: BROTHER KOGYO KABUSHIKI KAISHA, Nagoya (JP)

(72) Inventor: Shougo Sato, Seto (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 0 days.

(21) Appl. No.: 17/410,062

(22) Filed: Aug. 24, 2021

(65) Prior Publication Data

US 2022/0066384 A1 Mar. 3, 2022

(30) Foreign Application Priority Data

Aug. 28, 2020 (JP) ..... JP2020-144725
May 14, 2021 (JP) ..... JP2021-082141

(51) Int. Cl.

| | |
|---|---|
| ***G03G 15/00*** | (2006.01) |
| ***G03G 21/00*** | (2006.01) |
| ***G03G 21/16*** | (2006.01) |
| ***G03G 21/18*** | (2006.01) |
| ***G03G 21/10*** | (2006.01) |

(52) U.S. Cl.
CPC ..... *G03G 21/1842* (2013.01); *G03G 21/105* (2013.01)

(58) Field of Classification Search
CPC .. G03G 21/10; G03G 21/105; G03G 21/1671; G03G 21/1623; G03G 21/1842
USPC ..... 399/110, 116, 358
See application file for complete search history.

(56) References Cited

U.S. PATENT DOCUMENTS

| | | | | |
|---|---|---|---|---|
| 9,310,755 | B2 * | 4/2016 | Mori | G03G 21/1671 |
| 10,871,744 | B2 * | 12/2020 | Fujii et al. | G03G 21/1842 |
| 2016/0291527 | A1 | 10/2016 | Hashimoto et al. | |

FOREIGN PATENT DOCUMENTS

JP 2016-194583 A 11/2016

* cited by examiner

*Primary Examiner* — William J Royer
(74) *Attorney, Agent, or Firm* — Merchant & Gould P.C.

(57) ABSTRACT

An image forming apparatus includes a main housing, a drawer, and a drum unit. The drawer is movable between an accommodated position at which the drawer is accommodated in the main housing and a pulled-out position at which the drawer is pulled out from the main housing. The drum unit is attachable to the drawer in a state where the drawer is located at the pulled-out position. The drum unit includes a first photosensitive drum, a second photosensitive drum, and a waste toner pipe allowing passage of waste toner from the first photosensitive drum and waste toner from the second photosensitive drum.

37 Claims, 20 Drawing Sheets

IMAGE FORMING APPARATUS INCLUDING DRAWER AND DRUM UNIT ATTACHABLE TO DRAWER AND HAVING FIRST PHOTOSENSITIVE DRUM AND SECOND PHOTOSENSITIVE DRUM

CROSS REFERENCE TO RELATED APPLICATIONS

This application claims priority from Japanese Patent Application No. 2020-144725 filed Aug. 28, 2020 and No. 2021-082141 filed May 14, 2021. The entire content of each of the priority applications is incorporated herein by reference.

TECHNICAL FIELD

This disclosure relates to an image forming apparatus.

BACKGROUND

Conventionally, an image forming apparatus includes a main housing and a drawer. The drawer is movable between an accommodated position and a pulled-out position. In a state where the drawer is located at the accommodated position, the drawer is accommodated in the main housing. In a state where the drawer is located at the pulled-out position, the drawer is pulled out from the main housing. The drawer has a first photosensitive drum and a second photosensitive drum.

SUMMARY

According to one aspect, this specification discloses an image forming apparatus. The image forming apparatus includes a main housing, a drawer, and a drum unit. The drawer is movable between an accommodated position at which the drawer is accommodated in the main housing and a pulled-out position at which the drawer is pulled out from the main housing. The drum unit is attachable to the drawer in a state where the drawer is located at the pulled-out position. The drum unit includes a first photosensitive drum, a second photosensitive drum, and a waste toner pipe allowing passage of waste toner from the first photosensitive drum and waste toner from the second photosensitive drum.

According to another aspect, this specification also discloses an image forming apparatus. The image forming apparatus includes a main housing, a drawer, and a drum unit. The drawer is movable between an accommodated position at which the drawer is accommodated in the main housing and a pulled-out position at which the drawer is pulled out from the main housing. The drum unit includes a first photosensitive drum and a second photosensitive drum. The drum unit is attachable to the drawer in a state where the drawer is located at the pulled-out position. The drawer includes a positioning plate positioning the first photosensitive drum and the second photosensitive drum relative to the drawer in a state where the drum unit is attached to the drawer.

BRIEF DESCRIPTION OF THE DRAWINGS

Embodiments in accordance with this disclosure will be described in detail with reference to the following figures wherein.

DETAILED DESCRIPTION

In the above image forming apparatus, the drawer has a first photosensitive drum and a second photosensitive drum.

Thus, when it is desired to replace the first photosensitive drum and the second photosensitive drum, it is necessary to replace the entire drawer, which is inconvenient.

In view of the foregoing, an aspect of an objective of this disclosure is to provide an image forming apparatus in which a first photosensitive drum and a second photosensitive drum can be replaced easily.

1. Outline of Image Forming Apparatus 1

The outline of an image forming apparatus 1 of a first embodiment will be described with reference to FIGS. 1 and 2.

Figure 1:
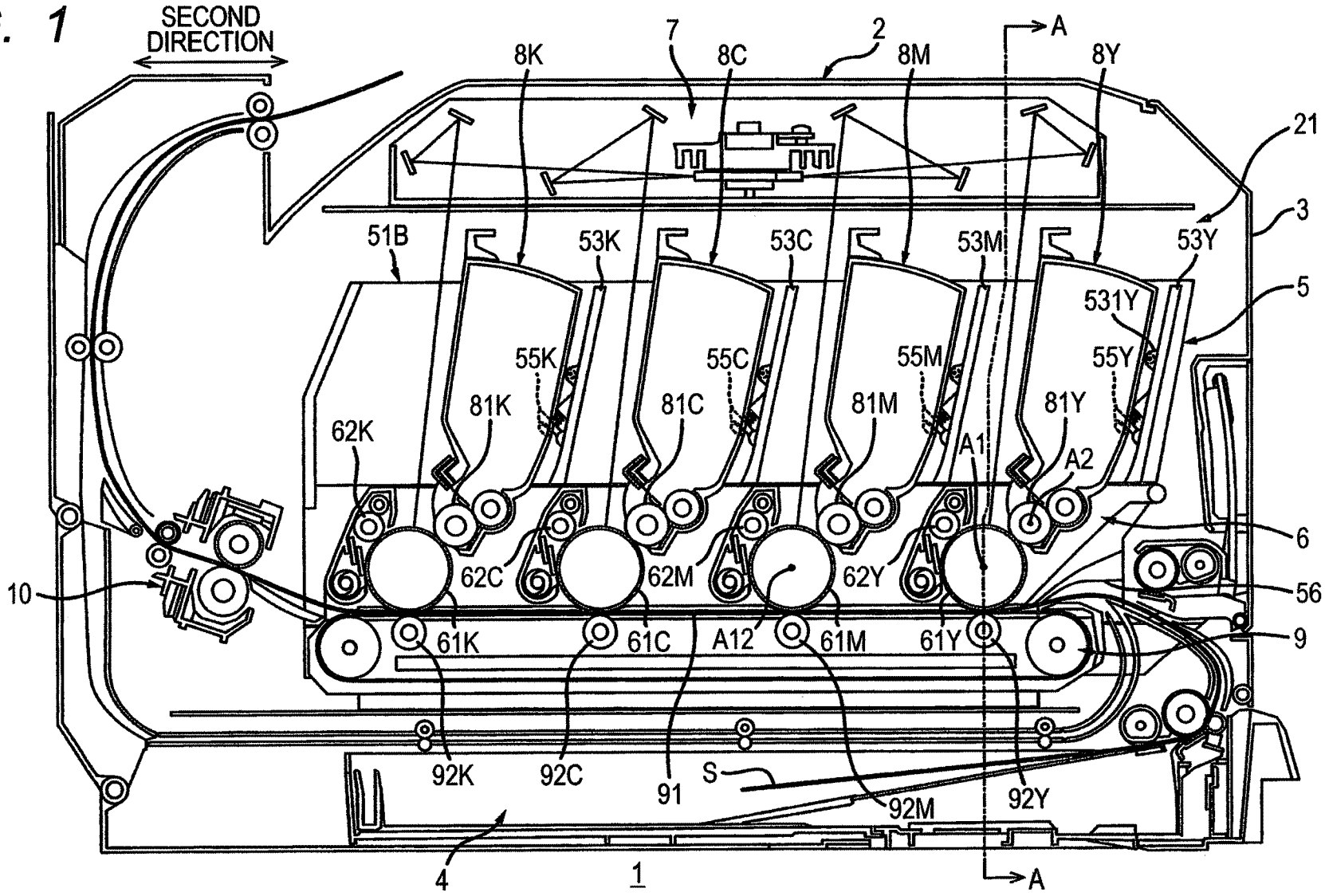
FIG. 1 is a diagram showing the schematic configuration of an image forming apparatus of a first embodiment.

As shown in FIG. 1, the image forming apparatus 1 includes a main housing 2, a cover 3, a sheet accommodating portion 4, a drawer 5, a drum unit 6, an exposure device 7, a plurality of cartridges 8Y, 8M, 8C, 8K, a transfer device 9, and a fixing device 10.

1.1 Main Housing 2

The main housing 2 accommodates the sheet accommodating portion 4, the drawer 5, the drum unit 6, the exposure device 7, the plurality of cartridges 8Y, 8M, 8C, 8K, the transfer device 9, and the fixing device 10. The main housing 2 has an opening 21.

1.2 Cover 3

Figure 2:
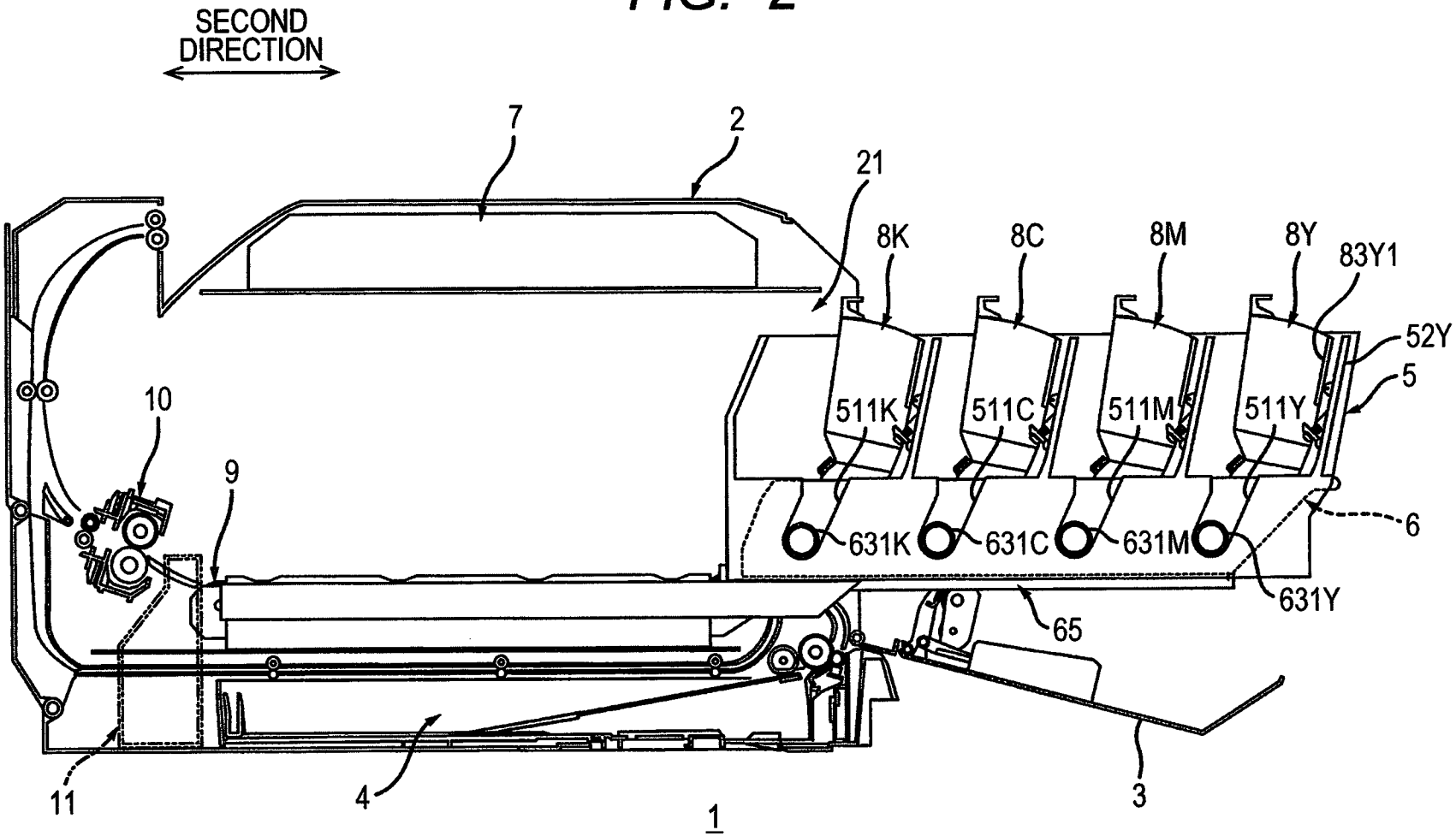
FIG. 2 shows a state in which a drawer of FIG. 1 is located at a pulled-out position.

The cover 3 is movable between a closed position (see FIG. 1) and an open position (see FIG. 2). As shown in FIG. 1, when the cover 3 is located at the closed position, the cover 3 closes the opening 21. As shown in FIG. 2, when the cover 3 is located at the open position, the opening 21 opens.

1.3 Sheet Accommodating Portion 4

As shown in FIG. 1, the sheet accommodating portion 4 accommodates a sheet S. The sheet S in the sheet accommodating portion 4 is conveyed toward the transfer device 9.

1.4 Drawer 5

As shown in FIG. 2, in a state where the cover 3 is located at the open position, the drawer 5 is movable through the opening 21 between an accommodated position (see FIG. 1) and a pulled-out position (see FIG. 2). The drawer 5 is movable in the direction in which photosensitive drums 61Y, 61M, 61C, and 61K (see FIG. 1) are arranged. The photosensitive drums 61Y, 61M, 61C, and 61K will be described later. As shown in FIG. 1, in a state where the drawer 5 is located at the accommodated position, the entire drawer 5 is accommodated in the main housing 2. As shown in FIG. 2, in a state where the drawer 5 is located at the pulled-out position, at least part of the drawer 5 is pulled out from the main housing 2.

1.5 Drum Unit 6

Figure 3:
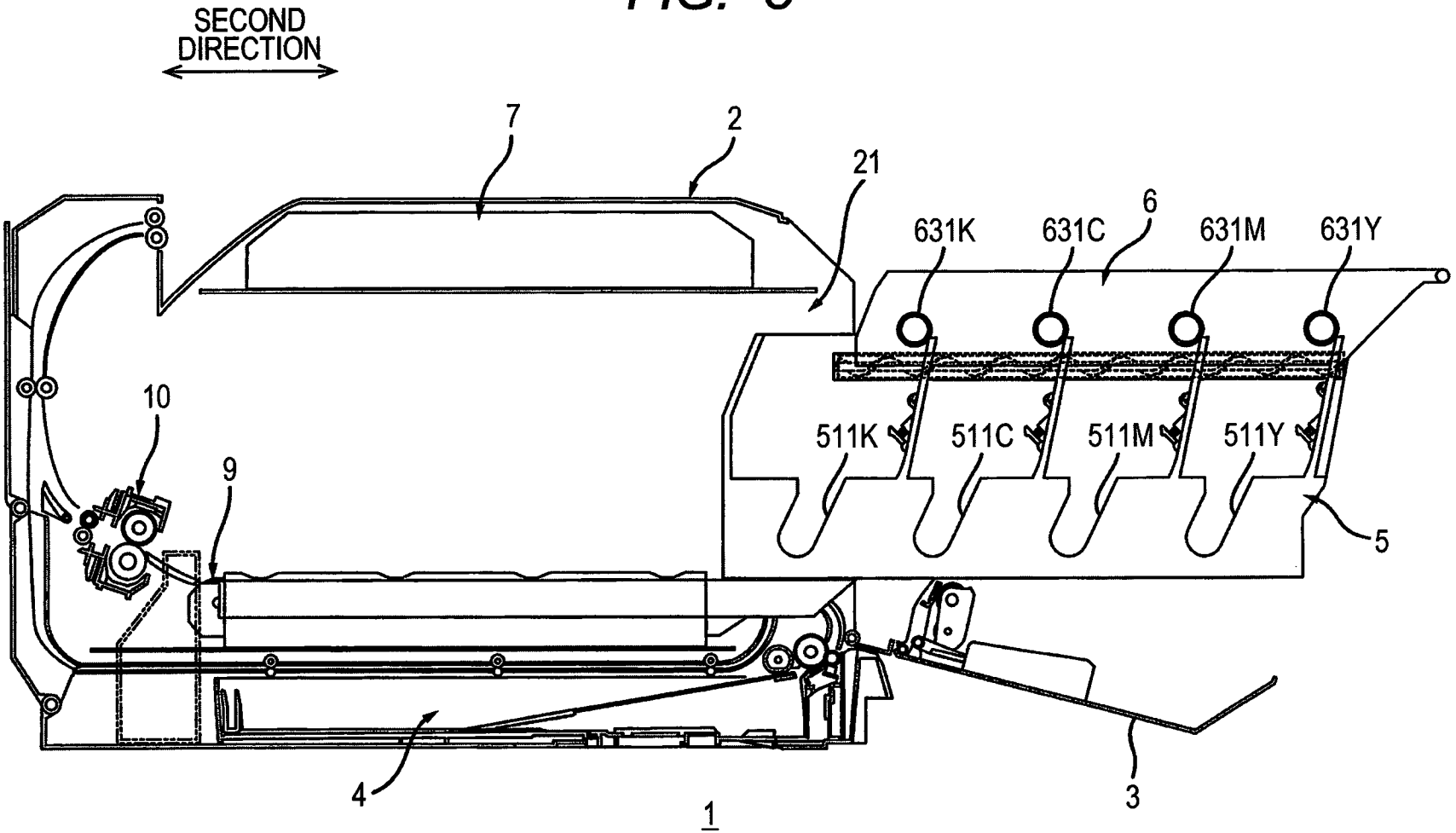
FIG. 3 shows a state in which a drum unit of FIG. 2 is detached from the drawer.

As shown in FIG. 3, in a state where the drawer 5 is located at the pulled-out position, the drum unit 6 is attachable to the drawer 5.

As shown in FIG. 1, the drum unit 6 includes a plurality of photosensitive drums 61Y, 61M, 61C, 61K and a plurality of charging devices 62Y, 62M, 62C, 62K.

1.5.1 Photosensitive Drum 61Y, 61M, 61C, 61K

The photosensitive drum 61Y is rotatable about a first axis A1. The first axis A1 extends in a first direction. The photosensitive drum 61Y extends in the first direction.

The photosensitive drums 61Y, 61M, 61C, and 61K are arranged in a second direction. The second direction crosses the first direction. Preferably, the second direction is perpendicular to the first direction.

Each of the photosensitive drums 61M, 61C, and 61K will be described in the same manner as the photosensitive drum 61Y. Thus, the description of the photosensitive drums 61M, 61C, and 61K will be omitted. That is, the photosensitive drum 61M is rotatable about a second axis A12. The second axis A12 substantially extends in the first direction. The second axis A12 may be parallel to the first axis A1, or may not be parallel to the first axis A1 and may have an angle of several degrees.

1.5.2 Charging Device 62Y, 62M, 62C, 62K

The charging device 62Y charges the peripheral surface of the photosensitive drum 61Y. The charging device 62M charges the peripheral surface of the photosensitive drum 61M. The charging device 62C charges the peripheral surface of the photosensitive drum 61C. The charging device 62K charges the peripheral surface of the photosensitive drum 61K.

In this embodiment, each of the charging devices 62Y, 62M, 62C, and 62K is a charging roller. Alternatively, each of the charging devices 62Y, 62M, 62C, and 62K may be a scorotron charger.

1.6 Exposure device 7

In a state where the drum unit 6 is attached to the drawer 5 and the drawer 5 is located at the accommodated position, the exposure device 7 exposes the peripheral surfaces of the photosensitive drums 61Y, 61M, 61C, and 61K. In this embodiment, the exposure device 7 is a laser scan unit.

1.7 Cartridges 8Y, 8M, 8C, 8K

As shown in FIG. 2, in a state where the drawer 5 is located at the pulled-out position, each of the cartridges 8Y, 8M, 8C, 8K is attachable to the drawer 5. Specifically, in a state where the drawer 5 is located at the pulled-out position and the drum unit 6 is attached to the drawer 5, each of the cartridges 8Y, 8M, 8C, and 8K is attachable to the drawer 5.

The cartridge 8Y accommodates the toner supplied to the photosensitive drum 61Y. The cartridge 8M accommodates the toner supplied to the photosensitive drum 61M. The cartridge 8C accommodates the toner supplied to the photosensitive drum 61C. The cartridge 8K accommodates the toner supplied to the photosensitive drum 61K.

As shown in FIG. 1, the cartridge 8Y includes a development roller 81Y.

The development roller 81Y supplies the toner in the cartridge 8Y to the photosensitive drum 61Y. In a state where the drum unit 6 is attached to the drawer 5 and the cartridge 8Y is attached to the drawer 5, the development roller 81Y contacts the photosensitive drum 61Y. The development roller 81Y may be configured to separate from the photosensitive drum 61Y. In a state where the drum unit 6 is attached to the drawer 5 and the cartridge 8Y is attached to the drawer 5, the development roller 81Y extends in the first direction. The development roller 81Y is rotatable about an axis A2. In a state where the drum unit 6 is attached to the drawer 5 and the cartridge 8Y is attached to the drawer 5, the axis A2 substantially extends in the first direction. The axis A2 may be parallel to the first axis A1, or may not be parallel to the first axis A1 and may have an angle of several degrees.

Each of the cartridges 8M, 8C and 8K will be described in the same manner as the cartridge 8Y. Thus, the description of the cartridges 8M, 8C, and 8K will be omitted.

1.8 Transfer Device 9

In a state where the drum unit 6 is attached to the drawer 5 and the drawer 5 is located at the accommodated position, the transfer device 9 is located below the photosensitive drums 61Y, 61M, 61C, and 61K. The transfer device 9 includes a belt 91 and transfer rollers 92Y, 92M, 92C, and 92K.

The belt 91 conveys the sheet S from the sheet accommodating portion 4 toward the fixing device 10. In a state where the drum unit 6 is attached to the drawer 5 and the drawer 5 is located at the accommodated position, the belt 91 contacts the photosensitive drums 61Y, 61M, 61C, and 61K.

The transfer roller 92Y transfers the toner on the photosensitive drum 61Y to the sheet S conveyed by the belt 91. The transfer roller 92M transfers the toner on the photosensitive drum 61M to the sheet S conveyed by the belt 91. The transfer roller 92C transfers the toner on the photosensitive drum 61C to the sheet S conveyed by the belt 91. The transfer roller 92K transfers the toner on the photosensitive drum 61K to the sheet S conveyed by the belt 91.

1.9 Fixing Device 10

The fixing device 10 heats and pressurizes the sheet S on which the toner is transferred to fix the toner on the sheet S. The sheet S that has passed through the fixing device 10 is discharged to the upper surface of the main housing 2.

2. Details of Drum Unit 6

The details of the drum unit 6 will be described with reference to FIGS. 2 and 4 to 7.

In addition to the above-mentioned photosensitive drums 61Y, 61M, 61C, 61K and charging devices 62Y, 62M, 62C, 62K, the drum unit 6 includes a drum side plate 63A (see FIG. 4), a drum side plate 63B (see FIG. 4), drum cleaners 64Y, 64M, 64C, 64K (see FIG. 5), a waste toner pipe 65 (see FIG. 6A), and a screw 66.

2.1 Drum Side Plate 63A

Figure 4:
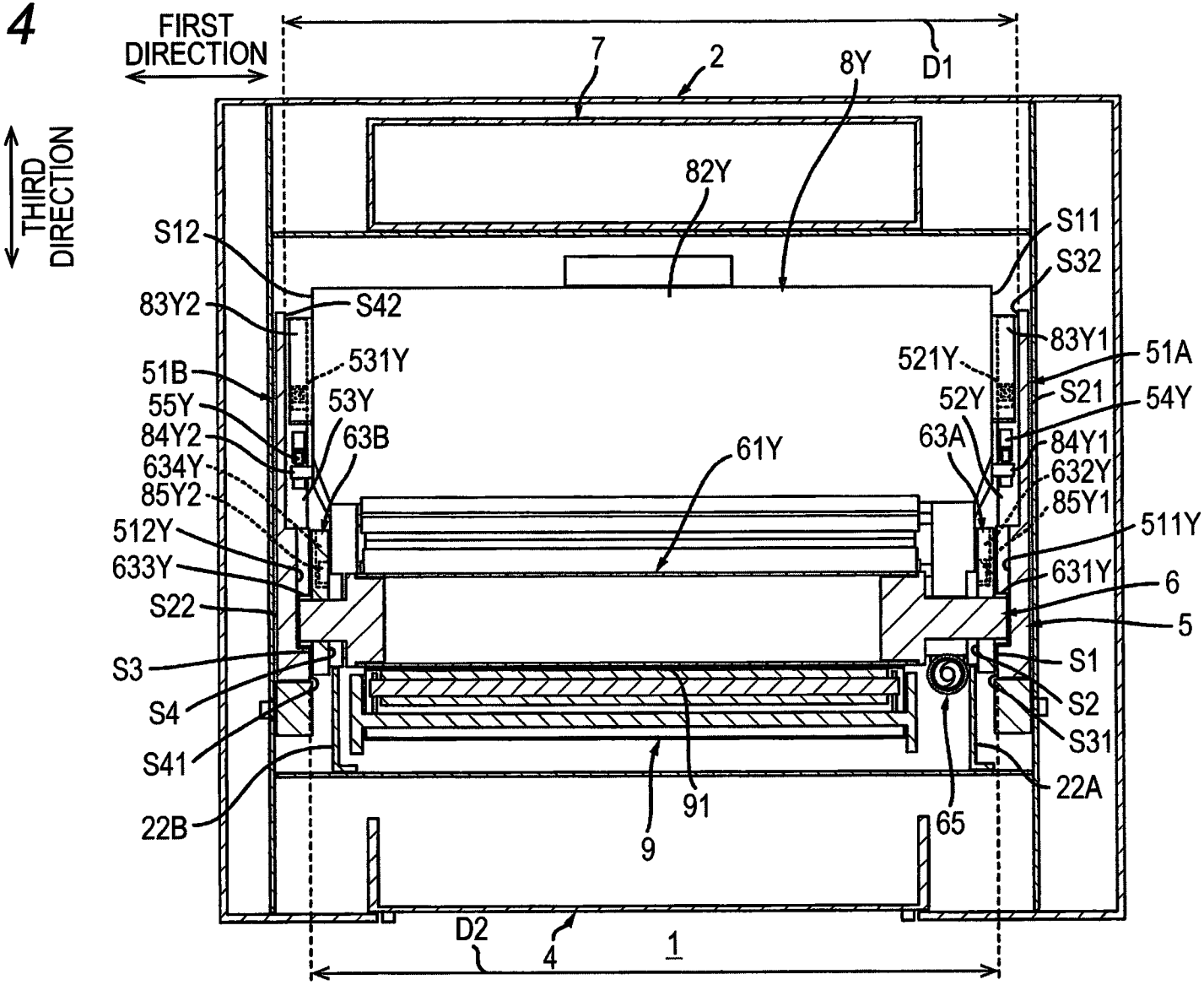
FIG. 4 is a cross-sectional view taken along a line A-A of FIG. 1.

As shown in FIG. 4, the drum side plate 63A is located at one end of the drum unit 6 in the first direction. The drum side plate 63A extends in the second direction (see FIG. 6B) and a third direction. The third direction crosses the first direction and the second direction. The third direction is perpendicular to the first direction and the second direction. The drum side plate 63A supports one end of the photosensitive drum 61Y in the first direction. The drum side plate 63A also supports one end of the photosensitive drum 61M (see FIG. 5) in the first direction, one end of the photosensitive drum 61C (see FIG. 5) in the first direction, and one end of the photosensitive drum 61K (see FIG. 5) in the first direction. The drum side plate 63A has an outer surface S1 and an inner surface S2. The inner surface S2 is located between the outer surface S1 and the drum side plate 63B in the first direction.

Figure 6A:
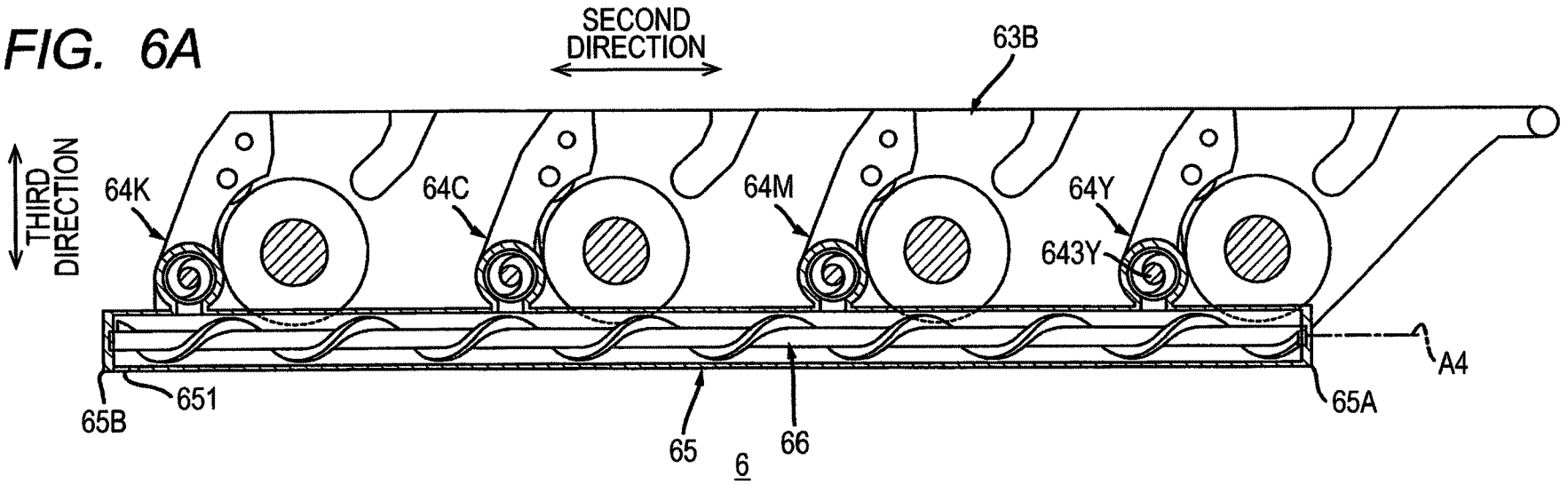
FIG. 6A is a cross-sectional view of the drum unit and shows a cross section through a waste toner pipe.
Figure 6B:
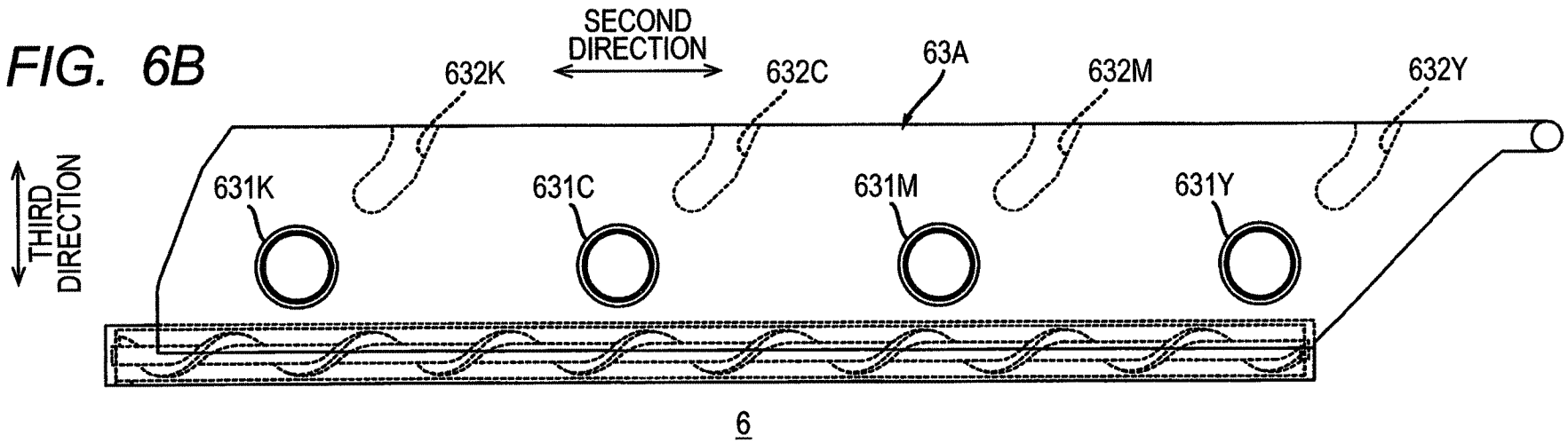
FIG. 6B is a side view of the drum unit.

As shown in FIG. 6B, the drum side plate 63A has a plurality of protrusions 631Y, 631M, 631C, 631K and a plurality of cartridge guides 632Y, 632M, 632C, 632K. In other words, the drum unit 6 has the cartridge guides 632Y, 632M, 632C, 632K.

As shown in FIG. 4, the protrusion 631Y is located at the outer surface S1 of the drum side plate 63A. The protrusion 631Y extends from the outer surface S1 of the drum side plate 63A. The protrusion 631Y may be attached to the outer surface S1 of the drum side plate 63A. In this embodiment, the protrusion 631Y has a cylindrical shape. The protrusion 631Y receives one end of the photosensitive drum 61Y in the first direction.

As shown in FIG. 6B, the protrusions 631Y, 631M, 631C, and 631K are arranged in the second direction. Each of the protrusions 631M, 631C and 631K will be described in the same manner as the protrusion 631Y. Thus, the description of each of the protrusions 631M, 631C, and 631K will be omitted.

The cartridge guide 632Y is located at the inner surface S2 (see FIG. 4) of the drum side plate 63A. When the cartridge 8Y is attached to the drawer 5 in a state where the drum unit 6 is attached to the drawer 5, a protrusion 85Y1 (see FIG. 4) of the cartridge 8Y fits into the cartridge guide 632Y. The protrusion 85Y1 will be described later. Thus, when the cartridge 8Y is attached to the drawer 5 in a state where the drum unit 6 is attached to the drawer 5, the cartridge guide 632Y guides the one end of the cartridge 8Y in the first direction. In this embodiment, the cartridge guide 632Y is a groove. The cartridge guide 632Y may be a rib.

The cartridge guides 632Y, 632M, 632C, and 632K are arranged in the second direction. When the cartridge 8M (see FIG. 2) is attached to the drawer 5 in a state where the drum unit 6 is attached to the drawer 5, the cartridge guide 632M guides one end of the cartridge 8M in the first direction. When the cartridge 8C (see FIG. 2) is attached to the drawer 5 in a state where the drum unit 6 is attached to the drawer 5, the cartridge guide 632C guides one end of the cartridge 8C in the first direction. When the cartridge 8K (see FIG. 2) is attached to the drawer 5 in a state where the drum unit 6 is attached to the drawer 5, the cartridge guide 632K guides one end of the cartridge 8K in the first direction.

Each of the cartridge guides 632M, 632C, and 632K will be described in the same manner as the cartridge guide 632Y. Thus, the description of each of the cartridge guides 632M, 632C, and 632K is omitted.

2.2 Drum Side Plate 63B

As shown in FIG. 4, the drum side plate 63B is located at the other end of the drum unit 6 in the first direction. The drum side plate 63B is located away from the drum side plate 63A in the first direction. The drum side plate 63B extends in the second direction (see FIG. 5) and the third direction. The drum side plate 63B supports the other end of the photosensitive drum 61Y in the first direction. The drum side plate 63B also supports the other end of the photosensitive drum 61M (see FIG. 5) in the first direction, the other end of the photosensitive drum 61C (see FIG. 5) in the first direction, and the other end of the photosensitive drum 61K (see FIG. 5) in the first direction. The drum side plate 63B has an outer surface S3 and an inner surface S4.

The inner surface S4 is located between the outer surface S3 and the drum side plate 63A in the first direction.

Figure 5:
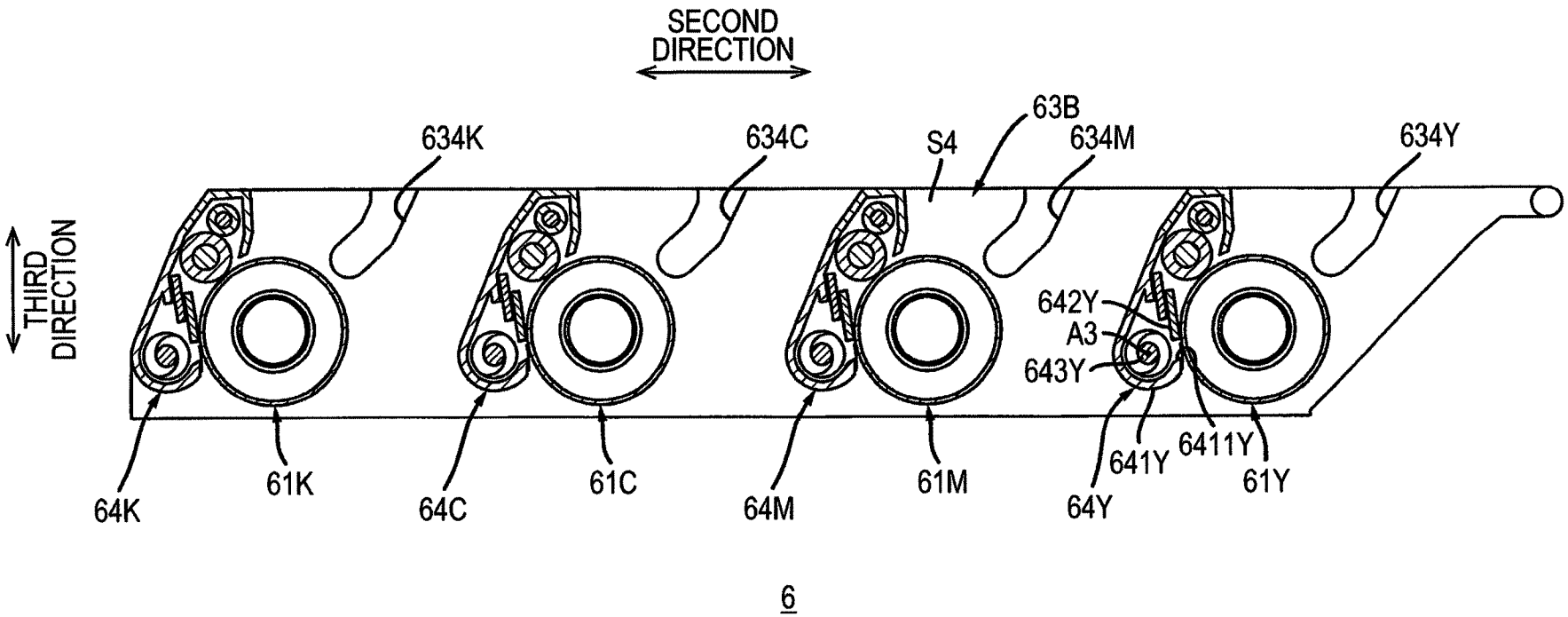
FIG. 5 is a cross-sectional view of the drum unit, showing a cross section through the center in a first direction.

The drum side plate 63B has a plurality of protrusions 633Y, 633M, 633C, 633K (the protrusions 633M, 633C, 633K are not shown) and a plurality of cartridge guides 634Y, 634M, 634C, 634K (see FIG. 5).

The protrusion 633Y is located at the outer surface S3 of the drum side plate 63B. The protrusion 633Y extends from the outer surface S3 of the drum side plate 63B. The protrusion 633Y may be attached to the outer surface S3 of the drum side plate 63B. In this embodiment, the protrusion 633Y has a cylindrical shape. The protrusion 633Y receives the other end of the photosensitive drum 61Y in the first direction.

The protrusions 633Y, 633M, 633C, and 633K are arranged in the second direction. Each of the protrusions 633M, 633C and 633K will be described in the same manner as the protrusion 633Y. Thus, the description of each of the protrusions 633M, 633C, and 633K will be omitted.

As shown in FIG. 5, the cartridge guide 634Y is located at the inner surface S4 of the drum side plate 63B. When the cartridge 8Y is attached to the drawer 5 in a state where the drum unit 6 is attached to the drawer 5, a protrusion 85Y2 (see FIG. 4) of the cartridge 8Y fits into the cartridge guide 634Y. The protrusion 85Y2 will be described later. Thus, when the cartridge 8Y is attached to the drawer 5 in a state where the drum unit 6 is attached to the drawer 5, the cartridge guide 634Y guides the other end of the cartridge 8Y in the first direction. In this embodiment, the cartridge guide 634Y is a groove. The cartridge guide 634Y may be a rib.

The cartridge guides 634Y, 634M, 634C, and 634K are arranged in the second direction. When the cartridge 8M (see FIG. 2) is attached to the drawer 5 in a state where the drum unit 6 is attached to the drawer 5, the cartridge guide 634M guides the other end of the cartridge 8M in the first direction. When the cartridge 8C (see FIG. 2) is attached to the drawer 5 in a state where the drum unit 6 is attached to the drawer 5, the cartridge guide 634C guides the other end of the cartridge 8C in the first direction. When the cartridge 8K (see FIG. 2) is attached to the drawer 5 in a state where the drum unit 6 is attached to the drawer 5, the cartridge guide 634K guides the other end of the cartridge 8K in the first direction.

Each of the cartridge guides 634M, 634C, and 634K will be described in the same manner as the cartridge guide 634Y. Thus, the description of each of the cartridge guides 634M, 634C, and 634K will be omitted.

2.3 Drum Cleaners 64Y, 64M, 64C, 64K

The drum cleaner 64Y cleans the surface of the photosensitive drum 61Y. The drum cleaner 64Y has a cleaning housing 641Y, a cleaning member 642Y, and a screw 643Y.

The cleaning housing 641Y stores waste toner from the photosensitive drum 61Y. The cleaning housing 641Y has an opening 6411Y.

The cleaning member 642Y cleans the surface of the photosensitive drum 61Y. The cleaning member 642Y is attached to the cleaning housing 641Y. The edge of the cleaning member 642Y contacts the surface of the photosensitive drum 61Y. The waste toner cleaned from the surface of the photosensitive drum 61Y by the cleaning member 642Y enters the cleaning housing 641Y through the opening 6411Y.

The screw 643Y is located in the cleaning housing 641Y. The screw 643Y conveys the waste toner in the cleaning housing 641Y toward the waste toner pipe 65 (see FIG. 6A). The screw 643Y extends in the first direction. The screw 643Y is rotatable about an axis A3. The axis A3 extends in the first direction. In this embodiment, the screw 643Y is an auger screw. The screw 643Y may be a shaftless screw.

The drum cleaner 64M cleans the surface of the photosensitive drum 61M. The drum cleaner 64C cleans the surface of the photosensitive drum 61C. The drum cleaner 64K cleans the surface of the photosensitive drum 61K.

Each of the drum cleaners 64M, 64C, and 64K is described in the same manner as the drum cleaner 64Y. Thus, the description of each of the drum cleaners 64M, 64C, and 64K is omitted.

2.4 Waste Toner Pipe 65

As shown in FIG. 6A, the waste toner pipe 65 is connected to each of the drum cleaners 64Y, 64M, 64C, and 64K. The waste toner pipe 65 allows the passage of waste toner from the drum cleaner 64Y, waste toner from the drum cleaner 64M, waste toner from the drum cleaner 64C, and waste toner from the drum cleaner 64K. In other words, the waste toner pipe 65 allows the passage of waste toner from the photosensitive drum 61Y, waste toner from the photosensitive drum 61M, waste toner from the photosensitive drum 61C, and waste toner from the photosensitive drum 61K. The waste toner pipe 65 extends in the second direction. The waste toner pipe 65 has one end 65A and an other end 65B in the second direction. The other end 65B is located away from the one end 65A in the second direction. The waste toner pipe 65 has a waste toner discharge port 651. The waste toner discharge port 651 is located at the other end 65B of the waste toner pipe 65 in the second direction. The waste toner discharge port 651 discharges the waste toner in the waste toner pipe 65.

As shown in FIG. 4, the waste toner pipe 65 is located between the drum side plate 63A and the drum side plate 63B in the first direction. In a state where the drum unit 6 is attached to the drawer 5, a part of the waste toner pipe 65 is located below the drum side plate 63A. In a state where the drum unit 6 is attached to the drawer 5 and the drawer 5 is located at the accommodated position, the waste toner pipe 65 is located between the transfer device 9 and the drum side plate 63A in the first direction. In a state where the drum unit 6 is attached to the drawer 5 and the drawer 5 is located at the accommodated position, the waste toner pipe 65 is located between the belt 91 and the drum side plate 63A in the first direction.

In a state where the drum unit 6 is attached to the drawer 5 and the drawer 5 is located at the accommodated position, the waste toner pipe 65 is located between a positioning plate 22A and a positioning plate 22B in the first direction. The main housing 2 has the positioning plate 22A and the positioning plate 22B.

In a state where the drum unit 6 is attached to the drawer 5 and the drawer 5 is located at the accommodated position, the positioning plate 22A is located between the waste toner pipe 65 and the drum side plate 63A in the first direction. In a state where the drum unit 6 is attached to the drawer 5 and the drawer 5 is located at the accommodated position, the positioning plate 22A positions one end of the photosensitive drum 61Y in the first direction relative to the main housing 2. The positioning plate 22A extends in the second direction and the third direction. The positioning plate 22A also positions one end of the photosensitive drum 61M in the first direction, one end of the photosensitive drum 61C in the first direction, and one end of the photosensitive drum 61K in the first direction relative to the main housing 2.

The positioning plate 22B is located away from the positioning plate 22A in the first direction. The transfer device 9 is located between the positioning plate 22A and the positioning plate 22B in the first direction. In a state where the drum unit 6 is attached to the drawer 5 and the drawer 5 is located at the accommodated position, the positioning plate 22B is located between the transfer device 9 and the drum side plate 63B in the first direction. In a state where the drum unit 6 is attached to the drawer 5 and the drawer 5 is located at the accommodated position, the positioning plate 22B positions the other end of the photosensitive drum 61Y in the first direction relative to the main housing 2. The positioning plate 22B extends in the second direction and the third direction. The positioning plate 22B also positions the other end of the photosensitive drum 61M in the first direction, the other end of the photosensitive drum 61C in the first direction, and the other end of the photosensitive drum 61K in the first direction relative to the main housing 2.

Figure 7:
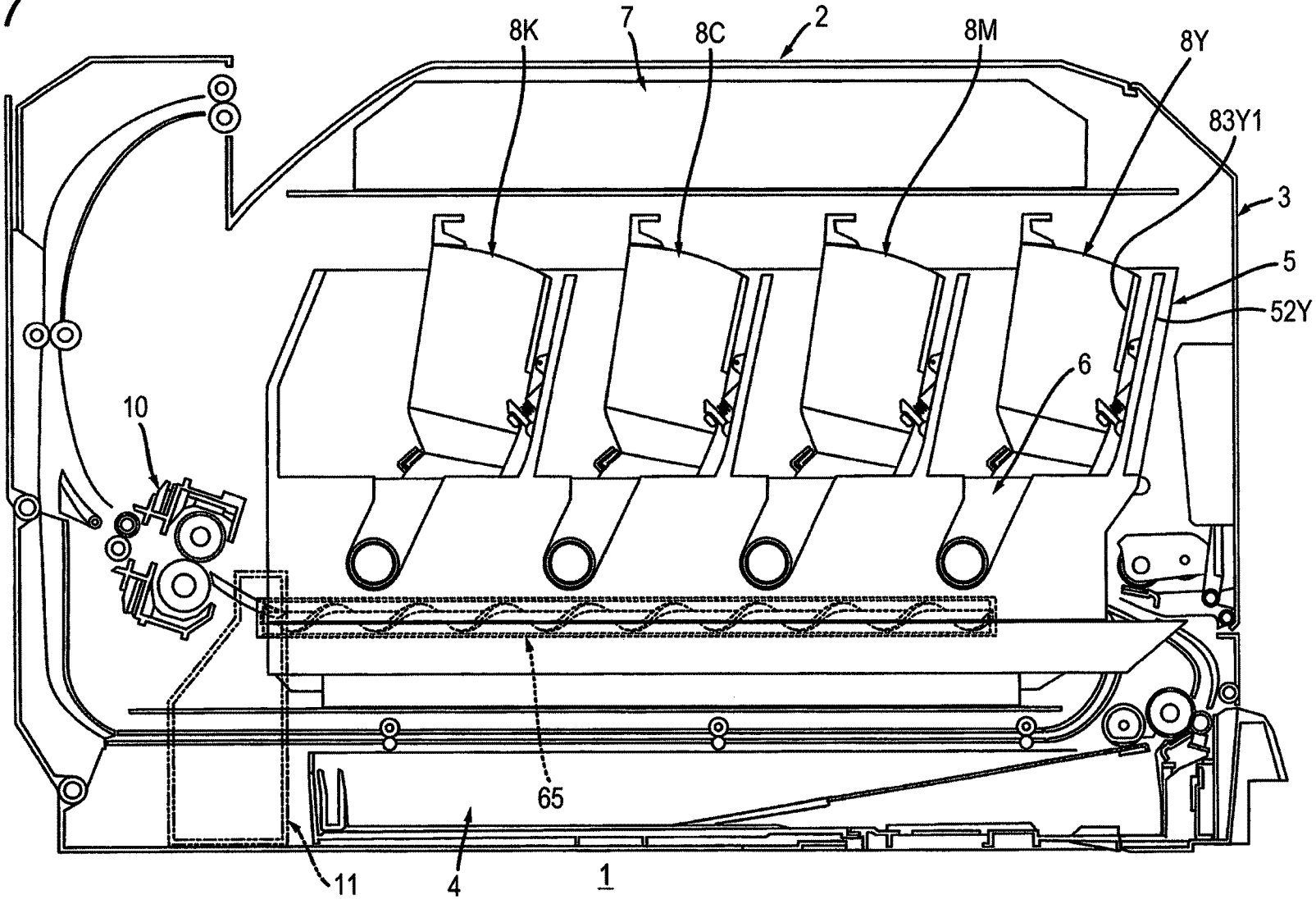
FIG. 7 is an explanatory diagram for illustrating a connection between the waste toner pipe and a waste-toner storage portion.

As shown in FIG. 7, in a state where the drum unit 6 is attached to the drawer 5 and the drawer 5 is located at the accommodated position, the waste toner pipe 65 is connected to a waste-toner storage portion 11. The image forming apparatus 1 further includes the waste-toner storage portion 11. The waste-toner storage portion 11 is located in the main housing 2. In a state where the waste toner pipe 65 is connected to a waste-toner storage portion 11, the waste toner discharged from the waste toner discharge port 651 (see FIG. 6A) enters the waste-toner storage portion 11. The waste-toner storage portion 11 stores waste toner. As shown in FIG. 2, in a state where the drum unit 6 is attached to the drawer 5 and the drawer 5 is located at the pulled-out position, the waste toner pipe 65 is separated from the waste-toner storage portion 11.

2.5 Screw 66

As shown in FIG. 6A, the screw 66 is located in the waste toner pipe 65. The screw 66 conveys the waste toner in the waste toner pipe 65 toward the waste toner discharge port 651. The screw 66 extends in the second direction. The screw 66 is rotatable about an axis A4. The axis A4 extends in the second direction. In this embodiment, the screw 66 is an auger screw. The screw 66 may be a shaftless screw.

3. Details of the Cartridge 8Y

The details of the cartridge 8Y will be described with reference to FIGS. 1 and 4.

As shown in FIG. 4, in addition to the development roller 81Y described above, the cartridge 8Y includes a cartridge housing 82Y, two ribs 83Y1 and 83Y2, two protrusions 84Y1 and 84Y2, and two protrusions 85Y1 and 85Y2.

3.1 Cartridge Housing 82Y

The cartridge housing 82Y stores toner. The cartridge housing 82Y extends in the first direction. The cartridge housing 82Y has one side surface S11 in the first direction and an other side surface S12 in the first direction.

3.2 Ribs 83Y1 and 83Y2

The rib 83Y1 is located on the side surface S11 of the cartridge 8Y. The rib 83Y1 extends from the side surface S11. The rib 83Y1 may be attached to the side surface S11.

In a state where the cartridge 8Y is attached to the drawer 5, the rib 83Y1 extends in the third direction.

The rib 83Y2 is located on the side surface S12 of the cartridge 8Y. The rib 83Y2 extends from the side surface S12. The rib 83Y2 may be attached to the side surface S12. In a state where the cartridge 8Y is attached to the drawer 5, the rib 83Y2 extends in the third direction.

3.3 Protrusions 84Y1 and 84Y2

The protrusion 84Y1 is located on the side surface S11 of the cartridge 8Y. The protrusion 84Y1 extends from the side surface S11. The protrusion 84Y1 extends in the first direction. The protrusion 84Y1 may be attached to the side surface S11. In a state where the drum unit 6 and the cartridge 8Y are attached to the drawer 5, the protrusion 84Y1 is located at the opposite side of the photosensitive drum 61Y (see FIG. 1) with respect to the development roller 81Y (see FIG. 1). The protrusion 84Y1 is located away from the rib 83Y1.

The protrusion 84Y2 is located on the side surface S12 of the cartridge 8Y. The protrusion 84Y2 extends from the side surface S12. The protrusion 84Y2 extends in the first direction. The protrusion 84Y2 may be attached to the side surface S12. In a state where the drum unit 6 and the cartridge 8Y are attached to the drawer 5, the protrusion 84Y2 is located at the opposite side of the photosensitive drum 61Y (see FIG. 1) with respect to the development roller 81Y (see FIG. 1). The protrusion 84Y2 is located away from the rib 83Y2.

3.4 Protrusions 85Y1 and 85Y2

The protrusion 85Y1 is located on the side surface S11 of the cartridge 8Y. The protrusion 85Y1 extends from the side surface S11. The protrusion 85Y1 extends in the first direction. The protrusion 85Y1 may be attached to the side surface S11. The protrusion 85Y1 extends along the axis A2 (see FIG. 1). The protrusion 85Y1 may be the shaft of the development roller 81Y. The protrusion 85Y1 has a cylindrical shape.

The protrusion 85Y2 is located on the side surface S12 of the cartridge 8Y. The protrusion 85Y2 extends from the side surface S12. The protrusion 85Y2 extends in the first direction. The protrusion 85Y2 may be attached to the side surface S12. The protrusion 85Y2 extends along the axis A2 (see FIG. 1). The protrusion 85Y2 may be the shaft of the development roller 81Y. The protrusion 85Y2 has a cylindrical shape.

4. Detail of Drawer 5

The drawer 5 will be described in detail by referring to FIGS. 1, 4, and 8.

The drawer 5 includes a drawer side plate 51A (see FIG. 4), a drawer side plate 51B (see FIG. 4), a plurality of ribs 52Y, 52M, 52C, and 52K (see FIG. 8), a plurality of ribs 53Y, 53M, 53C, and 53K (see FIG. 1), a plurality of development pressing members 54Y, 54M, 54C, and 54K (see FIG. 8), a plurality of development pressing members 55Y, 55M, 55C, and 55K (see FIG. 1), and a sheet guide 56 (see FIG. 1).

4.1 Drawer Side Plate 51A

As shown in FIG. 4, the drawer side plate 51A is located at one end of the drawer 5 in the first direction. The drawer side plate 51A extends in the second direction (see FIG. 8) and in the third direction. The drawer side plate 51A has an outer surface S21, an inner surface S31, and an inner surface S32.

The outer surface S21 is located at the opposite side of the drawer side plate 51B with respect to the inner surface S31 in the first direction.

The inner surface S31 is located between the outer surface S21 and the drum side plate 63A in the first direction. The inner surface S31 is located between the inner surface S32 and the drum side plate 63A in the first direction. In a state where the drum unit 6 is attached to the drawer 5, the inner surface S31 faces one end of the drum unit 6 in the first direction.

The inner surface S32 is located above the inner surface S31 in the third direction. The inner surface S32 is located away from the inner surface S31 in the first direction. The inner surface S32 is located between the outer surface S21 and the inner surface S31 in the first direction. In a state where the cartridge 8Y is attached to the drawer 5, the inner surface S32 faces one end of the cartridge 8Y in the first direction.

Figure 8:
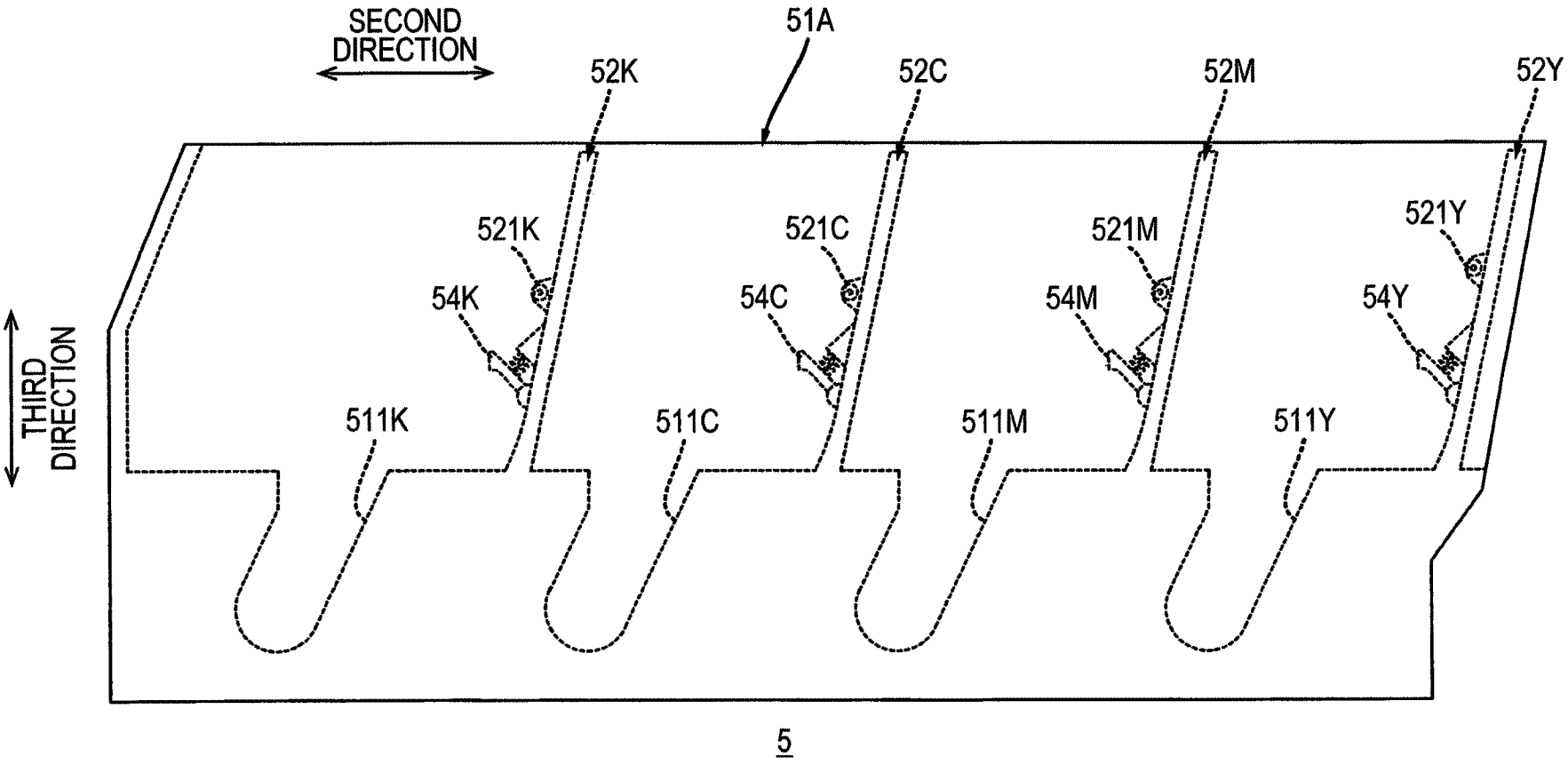
FIG. 8 is a side view of the drawer.

As shown in FIG. 8, the drawer side plate 51A includes a plurality of drum guides 511Y, 511M, 511C, and 511K. In other words, the drawer 5 includes the drum guides 511Y, 511M, 511C, and 511K.

The drum guides 511Y, 511M, 511C, and 511K are located at the inner surface S31 (see FIG. 4). The drum guides 511Y, 511M, 511C, and 511K are located between the inner surface S32 (see FIG. 4) and the drum side plate 63A (see FIG. 4) in the first direction. The drum guides 511Y, 511M, 511C, and 511K are aligned in the second direction. The drum guides 511Y, 511M, 511C, and 511K each extend in the third direction.

As shown in FIG. 3, when the drum unit 6 is attached to the drawer 5, the drum guide 511Y guides the protrusion 631Y of the drum unit 6, the drum guide 511M guides the protrusion 631M of the drum unit 6, the drum guide 511C guides the protrusion 631C of the drum unit 6, and the drum guide 511K guides the protrusion 631K of the drum unit 6.

As shown in FIGS. 2 and 4, in a state where the drum unit 6 is attached to the drawer 5, the protrusion 631Y of the drum unit 6 fits in the drum guide 511Y, the protrusion 631M of the drum unit 6 fits in the drum guide 511M, the protrusion 631C of the drum unit 6 fits in the drum guide 511C, and the protrusion 631K of the drum unit 6 fits in the drum guide 511K. Thus, the drawer side plate 51A supports the one end of the drum unit 6 in the first direction.

4.2 Drawer Side Plate 51B

As shown in FIG. 4, the drawer side plate 51B is located at the other end of the drawer 5 in the first direction. The drawer side plate 51B is located away from the drawer side plate 51A in the first direction. The drawer side plate 51B extends in the second direction and in the third direction. The drawer side plate 51B has an outer surface S22, an inner surface S41, and an inner surface S42.

The outer surface S22 is located at the opposite side of the drawer side plate 51A with respect to the inner surface S41 in the first direction.

The inner surface S41 is located between the outer surface S22 and the drum side plate 63B in the first direction. The inner surface S41 is located between the inner surface S42 and the drum side plate 63B in the first direction. In a state where the drum unit 6 is attached to the drawer 5, the inner surface S41 faces the other end of the drum unit 6 in the first direction.

The inner surface S42 is located above the inner surface S41 in the third direction. The inner surface S42 is located away from the inner surface S41 in the first direction. The inner surface S42 is located between the outer surface S22 and the inner surface S41 in the first direction. In a state where the cartridge 8Y is attached to the drawer 5, the inner surface S42 faces the other end of the cartridge 8Y in the first direction.

A distance D1 between the inner surface S32 and the inner surface S42 in the first direction is greater than a distance D2 between the inner surface S31 and the inner surface S41 in the first direction.

Like the drawer side plate 51A, the drawer side plate 51B includes a plurality of drum guides 512Y, 512M, 512C, and 512K. The drum guides 512M, 512C, and 512K are not shown in the drawings.

The drum guides 512Y, 512M, 512C, and 512K are located at the inner surface S41. The drum guides 512Y, 512M, 512C, and 512K are located between the inner surface S42 and the drum side plate 63B in the first direction. The drum guide 512Y has the same shape as the drum guide 511Y (see FIG. 8), the drum guide 512M has the same shape as the drum guide 511M (see FIG. 8), the drum guide 512C has the same shape as the drum guide 511C (see FIG. 8), and the drum guide 512K has the same shape as the drum guide 511K (see FIG. 8).

When the drum unit 6 is attached to the drawer 5, the drum guide 512Y guides the protrusion 633Y of the drum unit 6, the drum guide 512M guides the protrusion 633M of the drum unit 6, the drum guide 512C guides the protrusion 633C of the drum unit 6, and the drum guide 512K guides the protrusion 633K of the drum unit 6.

In a state where the drum unit 6 is attached to the drawer 5, the protrusion 633Y of the drum unit 6 fits in the drum guide 512Y, the protrusion 633M of the drum unit 6 fits in the drum guide 512M, the protrusion 633C of the drum unit 6 fits in the drum guide 512C, and the protrusion 633K of the drum unit 6 fits in the drum guide 512K. Thus, the drawer side plate 51B supports the other end of the drum unit 6 in the first direction.

4.3 Ribs 52Y, 52M, 52C, 52K

As shown in FIG. 4, the rib 52Y is located at the inner surface S32 of the drawer side plate 51A. The rib 52Y extends from the inner surface S32 of the drawer side plate 51A. The rib 52Y extends in the first direction and in the third direction. The rib 52Y may be attached to the inner surface S32 of the drawer side plate 51A. The rib 52Y is located at the opposite side of the drum side plate 63B with respect to the drum side plate 63A in the first direction.

As shown in FIG. 8, in this embodiment, the rib 52Y includes a protrusion 521Y.

The protrusion 521Y is attached to the rib 52Y. In this embodiment, the protrusion 521Y has a wheel. The protrusion 521Y may extend from the drawer side plate 51A.

As shown in FIG. 4, in a state where the cartridge 8Y is attached to the drawer 5, the protrusion 521Y contacts the one end of the cartridge 8Y in the first direction. More specifically, in a state where the cartridge 8Y is attached to the drawer 5, the protrusion 521Y contacts the rib 83Y1 of the cartridge 8Y. Thus, in a state where the cartridge 8Y is attached to the drawer 5, the rib 52Y supports the one end of the cartridge 8Y in the first direction.

As shown in FIG. 8, the ribs 52Y, 52M, 52C, and 52K are aligned in the second direction. The description of the rib 52Y is also applied to each of the ribs 52M, 52C, and 52K. Thus, the description of each of the ribs 52M, 52C, and 52K will be omitted.

4.4 Ribs 53Y, 53M, 53C, 53K

As shown in FIG. 4, the rib 53Y is located away from the rib 52Y in the first direction. The drum unit 6 passes through between the rib 52Y and the rib 53Y to be attached to the drawer 5.

The rib 53Y is located at the inner surface S42 of the drawer side plate 51B. The rib 53Y extends from the inner surface S42 of the drawer side plate 51B. The rib 53Y extends in the first direction and in the third direction. The rib 53Y may be attached to the inner surface S42 of the drawer side plate 51B. The rib 53Y is located at the opposite side of the drum side plate 63A with respect to the drum side plate 63B in the first direction.

As shown in FIG. 1, in this embodiment, the rib 53Y includes a protrusion 531Y.

The protrusion 531Y is attached to the rib 53Y. In this embodiment, the protrusion 531Y has a wheel. The protrusion 531Y may extend from the drawer side plate 51B.

As shown in FIG. 4, the protrusion 531Y is located away from the protrusion 521Y in the first direction. The drum unit 6 passes through between the protrusion 521Y and the protrusion 531Y to be attached to the drawer 5. In a state where the cartridge 8Y is attached to the drawer 5, the protrusion 531Y contacts the other end of the cartridge 8Y in the first direction. More specifically, in a state where the cartridge 8Y is attached to the drawer 5, the protrusion 531Y contacts the rib 83Y2 of the cartridge 8Y. Thus, in a state where the cartridge 8Y is attached to the drawer 5, the rib 53Y supports the other end of the cartridge 8Y in the first direction.

As shown in FIG. 1, the ribs 53Y, 53M, 53C, and 53K are aligned in the second direction. The description of the rib 53Y is also applied to each of the ribs 53M, 53C, and 53K. Thus, the description of each of the ribs 53M, 53C, and 53K will be omitted.

4.5 Development Pressing Members 54Y, 54M, 54C, 54K

As shown in FIG. 4, in this embodiment, the development pressing member 54Y is attached to the rib 52Y. The development pressing member 54Y may be attached to the drawer side plate 51A. In a state where the drum unit 6 is attached to the drawer 5, the development pressing member 54Y is located at the opposite side of the drum side plate 63B with respect to the drum side plate 63A in the first direction.

In a state where the drum unit 6 and the cartridge 8Y are attached to the drawer 5, the development pressing member 54Y presses the one end of the cartridge 8Y in the first direction toward the photosensitive drum 61Y. More specifically, the development pressing member 54Y presses the protrusion 84Y1 of the cartridge 8Y toward the photosensitive drum 61Y.

The description of the development pressing member 54Y is also applied to each of the development pressing members 54M, 54C, and 54K (see FIG. 8). Thus, the descriptions of the development pressing members 54M, 54C, and 54K will be omitted.

4.6 Development Pressing Members 55Y, 55M, 55C, 55K

The development pressing member 55Y is located away from the development pressing member 54Y in the first direction. The drum unit 6 passes through between the development pressing member 54Y and the development pressing member 55Y to be attached to the drawer 5.

In this embodiment, the development pressing member 55Y is attached to the rib 53Y. The development pressing member 55Y may be attached to the drawer side plate 51B. In a state where the drum unit 6 is attached to the drawer 5, the development pressing member 55Y is located at the opposite side of the drum side plate 63A with respect to the drum side plate 63B in the first direction.

In a state where the drum unit 6 and the cartridge 8Y are attached to the drawer 5, the development pressing member 55Y presses the other end of the cartridge 8Y in the first direction toward the photosensitive drum 61Y. More specifically, the development pressing member 55Y presses the protrusion 84Y2 of the cartridge 8Y toward the photosensitive drum 61Y.

The description of the development pressing member 55Y is also applied to the development pressing members 55M, 55C, and 55K (see FIG. 1). Thus, the descriptions of the development pressing members 55M, 55C, and 55K will be omitted.

4.7 Sheet Guide 56

As shown in FIG. 1, in a state where the drum unit 6 is attached to the drawer 5, the sheet guide 56 is located at the opposite side of the photosensitive drum 61M with respect to the photosensitive drum 61Y. In a state where the drum unit 6 is attached to the drawer 5 and the drawer 5 is located at the accommodated position, the sheet guide 56 guides the sheet S conveyed toward the photosensitive drum 61Y. More specifically, the sheet guide 56 guides, toward the belt 91, the sheet S that is conveyed toward the photosensitive drum 61Y.

5. Operations and Effects (1) As shown in FIG. 3, according to the image forming apparatus 1, the drum unit 6 having the photosensitive drums 61Y, 61M, 61C, and 61K (see FIG. 1) can be replaced relative to the drawer 5.

This facilitates replacement of the photosensitive drums 61Y, 61M, 61C, and 61K.

The drum unit 6 includes the waste toner pipe 65.

Thus, the waste toner pipe 65 does not separate from the drum unit 6 when the drum unit 6 is detached from the drawer 5.

As a result, the occurrence of leakage of waste toner is reduced during replacement of the drum unit 6.

(2) As shown in FIG. 4, in the image forming apparatus 1, the distance D1 between the inner surface S32 and the inner surface S42 in the first direction is greater than the distance D2 between the inner surface S31 and the inner surface S41 in the first direction.

Thus, the drum unit 6 is allowed to pass through easily between the inner surface S32 and the inner surface S42.

This allows the drum unit 6 to be replaced smoothly.

(3) As shown in FIG. 4, in the image forming apparatus 1, the rib 52Y is located at the opposite side of the drum side plate 63B with respect to the drum side plate 63A in the first direction. The rib 53Y is located at the opposite side of the drum side plate 63A with respect to the drum side plate 63B in the first direction.

Thus, in a state where the cartridge 8Y is attached to the drawer 5, the cartridge 8Y is supported stably by the rib 52Y and the rib 53Y. Further, the drum unit 6 can be replaced by passing through between the rib 52Y and the rib 53Y.

(4) As shown in FIG. 4, in the image forming apparatus 1, the development pressing member 54Y is located at the opposite side of the drum side plate 63B with respect to the drum side plate 63A in the first direction. The development pressing member 55Y is located at the opposite side of the drum side plate 63A with respect to the drum side plate 63B in the first direction.

Thus, in a state where the cartridge 8Y is attached to the drawer 5, the cartridge 8Y is pressed against the photosensitive drum 61Y by the development pressing member 54Y and the development pressing member 55Y. Further, the drum unit 6 can be replaced by passing through between the development pressing member 54Y and the development pressing member 55Y.

6. Second Embodiment

Next, a second embodiment will be described with reference to FIGS. 9 to 20. In the second embodiment, the same members as those in the first embodiment are designated by the same reference numerals, and the description thereof will be omitted.

6.1 Detail of Drum Unit 20

Figure 10:
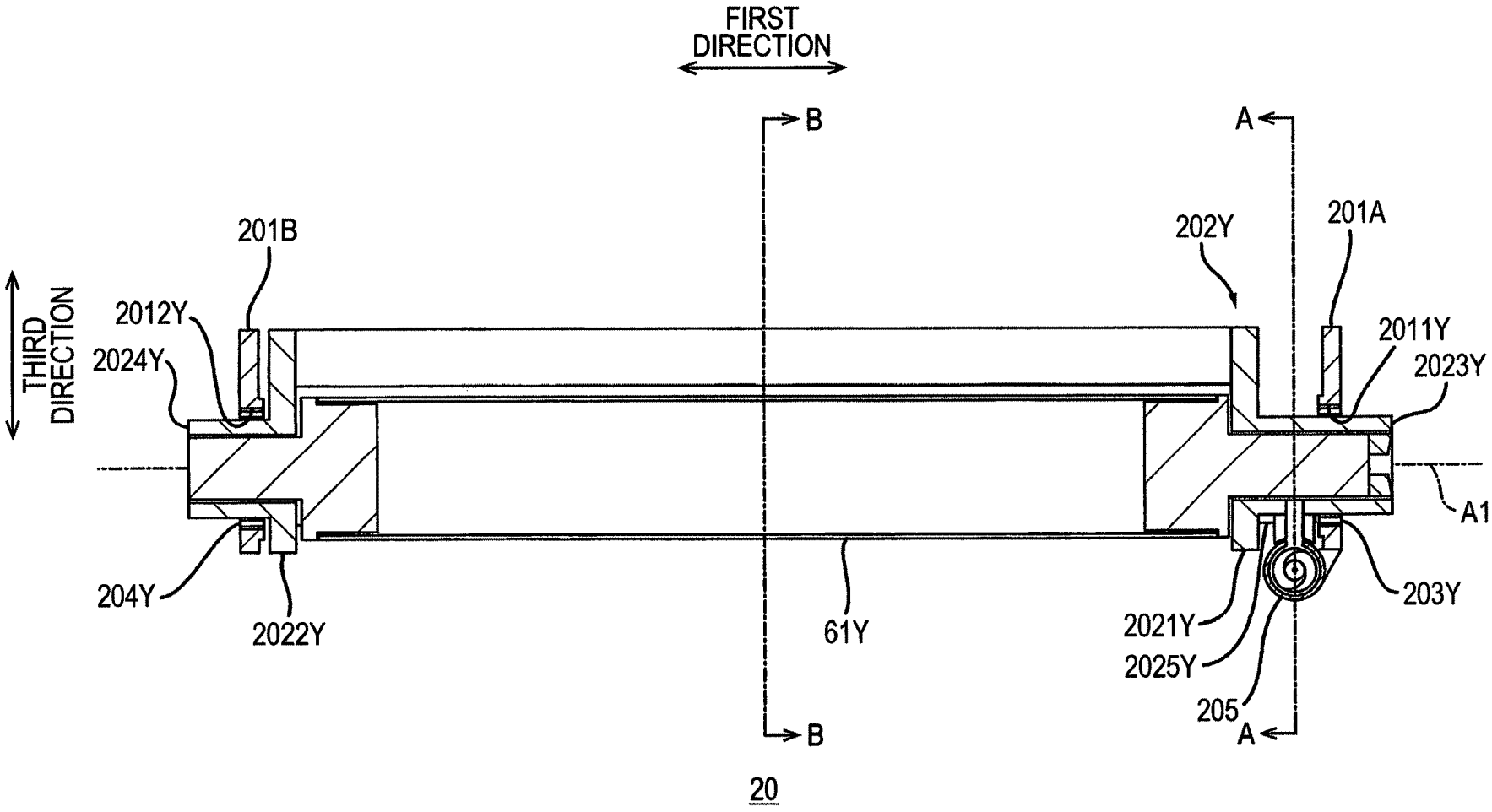
FIG. 10 is a cross-sectional view of the drum unit of FIG. 9.
Figure 11:
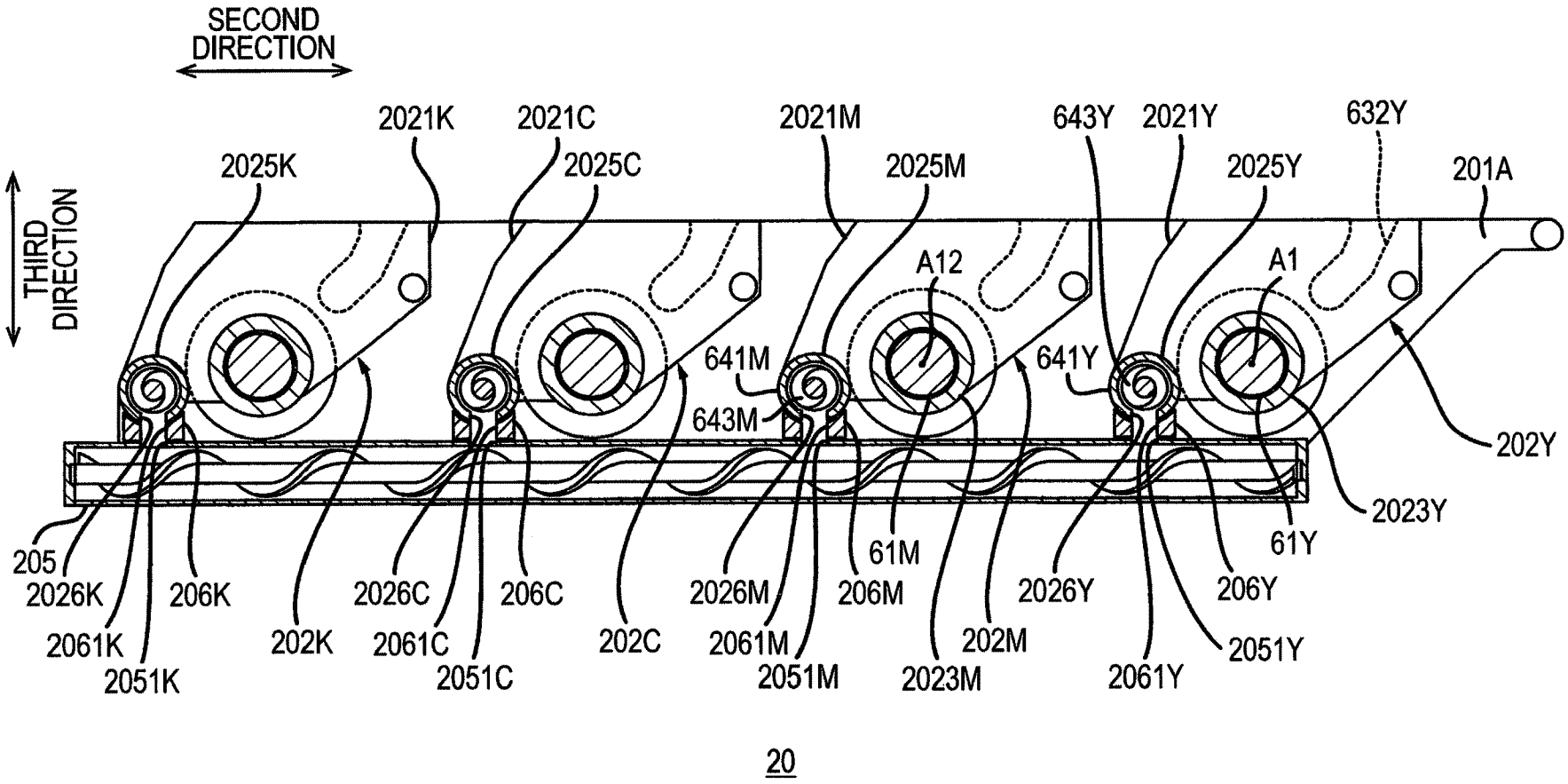
FIG. 11 is a cross-sectional view taken along a line A-A of the drum unit of FIG. 10.

The drum unit 20 includes a drum side plate 201A (see FIG. 9), a drum side plate 201B (see FIG. 10), a plurality of frames 202Y, 202M, 202C, and 202K (see FIG. 11), a plurality of elastic members 203Y, 203M, 203C, and 203K (see FIG. 9), a plurality of elastic members 204Y (see FIG. 10), 204M, 204C, and 204K, a waste toner pipe 205 (see FIG. 9), and a plurality of seal members 206Y, 206M, 206C, and 206K (see FIG. 11). The elastic members 204M, 204C, and 204K are not shown in the drawings.

6.1.1 Drum Side Plate 201A

Figure 9:
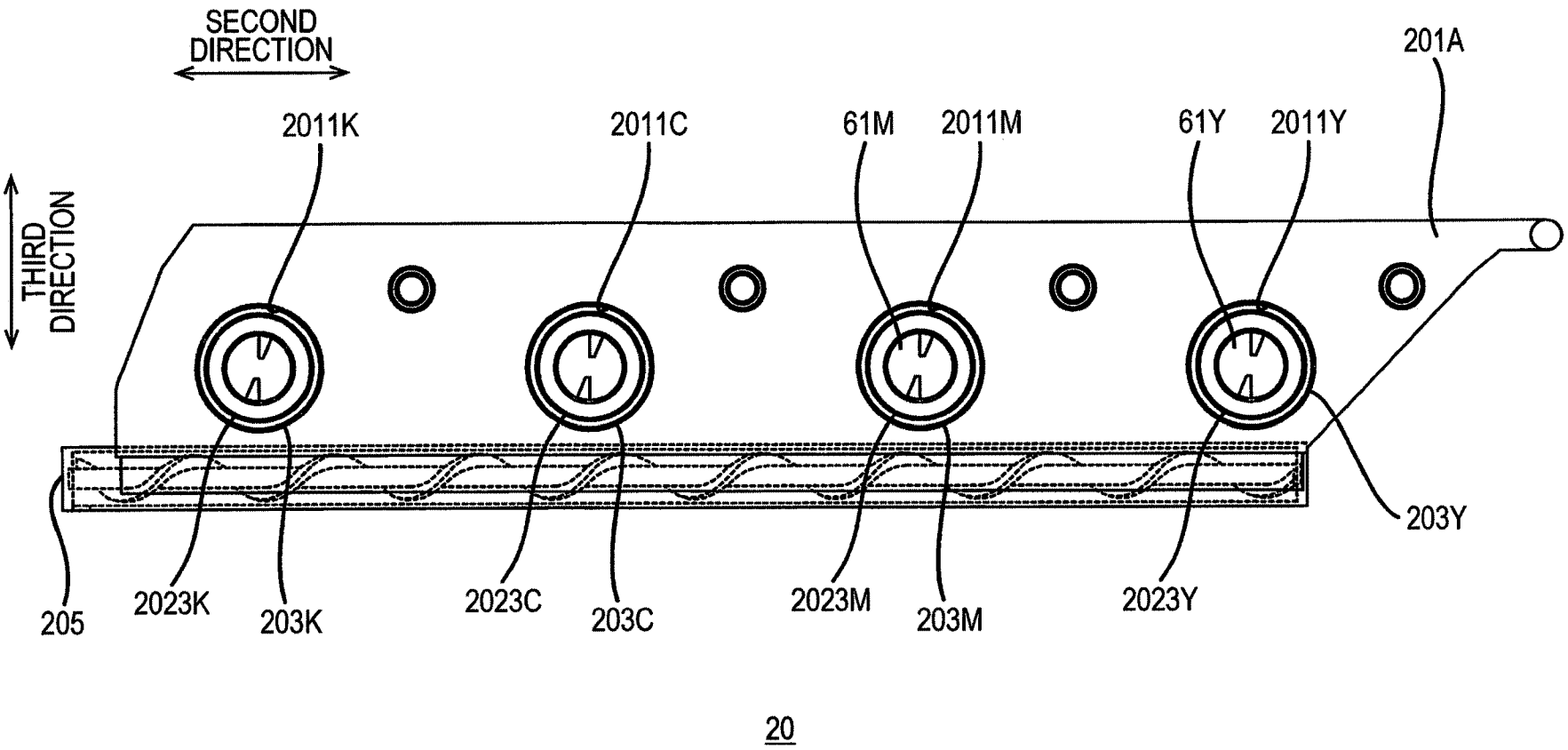
FIG. 9 is a side view of a drum unit detached from a drawer of an image forming apparatus of a second embodiment.

As shown in FIG. 10, the drum side plate 201A is located at one end of the drum unit 20 in the first direction. As shown in FIG. 9, the drum side plate 201A extends in the second direction and in the third direction. The third direction crosses the first direction and the second direction. Preferably, the third direction is perpendicular to the first direction and the second direction. The drum side plate 201A supports the frames 202Y, 202M, 202C, and 202K. More specifically, as shown in FIG. 11, the drum side plate 201A supports one end of each of the frames 202Y, 202M, 202C, and 202K in the first direction. As shown in FIG. 9, the drum side plate 201A has a plurality of through holes 2011Y, 2011M, 2011C, and 2011K.

The through holes 2011Y, 2011M, 2011C, and 2011K are aligned in the second direction. In other words, the through holes 2011Y, 2011M, 2011C, and 2011K are aligned in a movement direction of the drawer 30 (see FIGS. 1 and 2). The through holes 2011Y, 2011M, 2011C, and 2011K each have a circular shape.

6.1.2 Drum Side Plate 201B

As shown in FIG. 10, the drum side plate 201B is located at the other end of the drum unit 20 in the first direction. The drum side plate 201B is located away from the drum side plate 201A in the first direction. The drum side plate 201B extends in the second direction and in the third direction. The drum side plate 201B supports the frames 202Y, 202M, 202C, and 202K (see FIG. 11) in cooperation with the drum side plate 201A. More specifically, the drum side plate 201B supports the other end of each of the frames 202Y, 202M, 202C, and 202K in the first direction. The drum side plate 201B has a plurality of through holes 2012Y, 2012M, 2012C, and 2012K. The through holes 2012M, 2012C, and 2012K are not shown in the drawings.

The through holes 2012Y, 2012M, 2012C, and 2012K are aligned in the second direction. In other words, the through holes 2012Y, 2012M, 2012C, and 2012K are aligned in the movement direction of the drawer 30 (see FIG. 19). The through holes 2012Y, 2012M, 2012C, and 2012K each have a circular shape.

6.1.3 Frame 202Y

Figure 12:
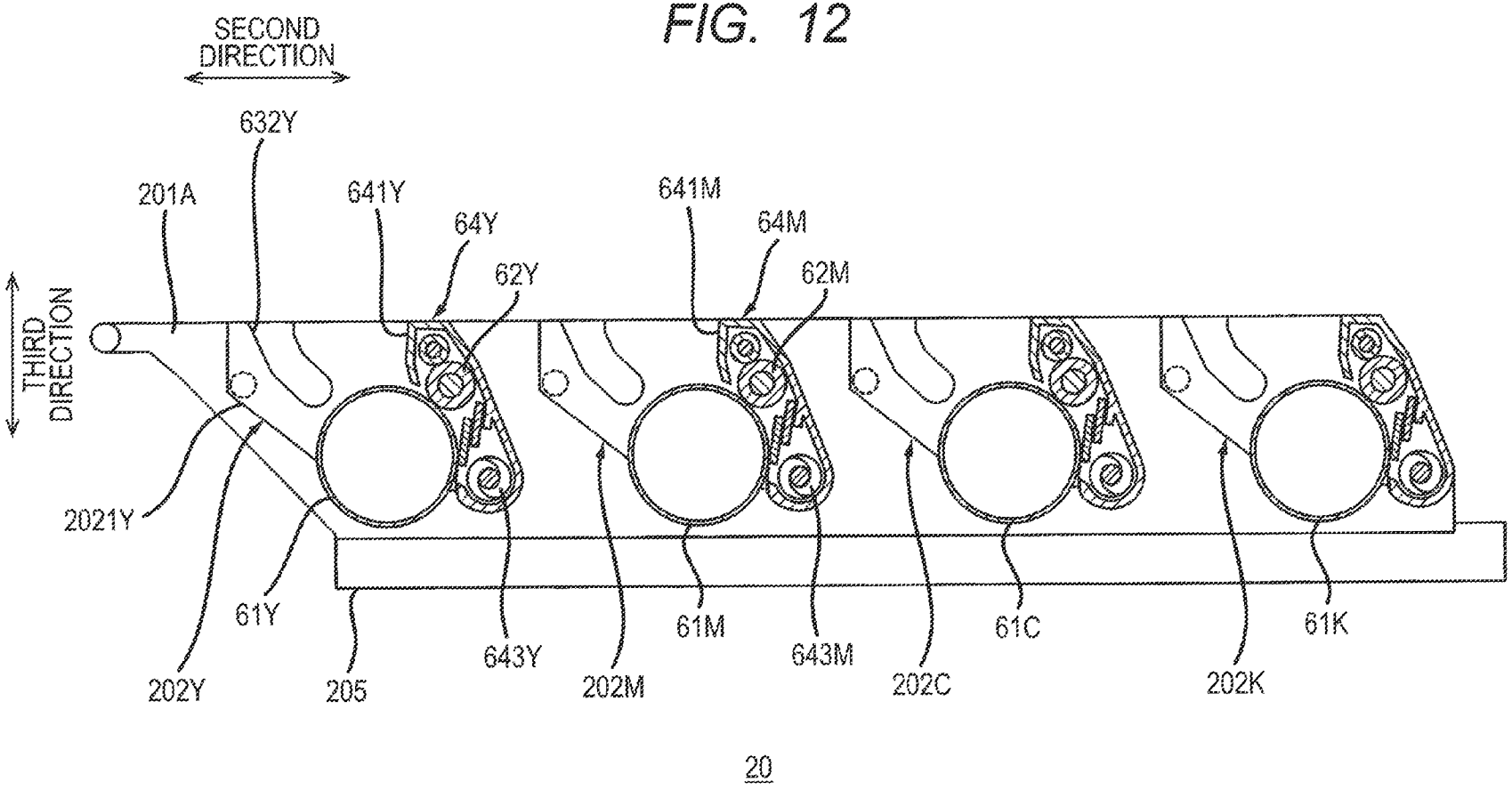
FIG. 12 is a cross-sectional view taken along a line B-B of the drum unit of FIG. 10.

As shown in FIG. 12, the frame 202Y supports the photosensitive drum 61Y described above and the charging device 62Y. The frame 202Y includes the drum cleaner 64Y described above. In other words, the frame 202Y includes the cleaning housing 641Y as a first waste toner storage portion and the screw 643Y as a first conveyance member.

The frame 202Y extends in the first direction. As shown in FIG. 10, the frame 202Y includes a frame side plate 2021Y, a frame side plate 2022Y, a support portion 2023Y, a support portion 2024Y, and a discharge portion 2025Y (see FIG. 11).

6.1.3.1 Frame Side Plate 2021Y

The frame side plate 2021Y is located at one end of the frame 202Y in the first direction. As shown in FIG. 11, the frame side plate 2021Y extends in the second direction and in the third direction. As shown in FIG. 12, the frame side plate 2021Y has the cartridge guide 632Y described above.

6.1.3.2 Frame Side Plate 2022Y

As shown in FIG. 10, the frame side plate 2022Y is located at the other end of the frame 202Y in the first direction. The frame side plate 2022Y is located away from the frame side plate 2021Y in the first direction. The frame side plate 2022Y extends in the second direction and in the third direction. The frame side plate 2022Y has the cartridge guide 634Y (see FIG. 5) described above.

6.1.3.3 Support Portion 2023Y

The support portion 2023Y is located at the opposite side of the frame side plate 2022Y with respect to the frame side plate 2021Y in the first direction. The support portion 2023Y extends from the frame side plate 2021Y. The support portion 2023Y may be attached to the frame side plate 2021Y. The support portion 2023Y extends in the first direction. The support portion 2023Y has a circular cylindrical shape. The support portion 2023Y supports the one end of the photosensitive drum 61Y in the first direction.

The support portion 2023Y fits in the through hole 2011Y of the drum side plate 201A. The support portion 2023Y passes through the through hole 2011Y of the drum side plate 201A. The outer peripheral surface of the support portion 2023Y is located at an interval relative to the inner peripheral surface of the through hole 2011Y of the drum side plate 201A. Thus, the frame 202Y is movable relative to the drum side plate 201A.

6.1.3.4 Support Portion 2024Y

The support portion 2024Y is located at the opposite side of the frame side plate 2021Y with respect to the frame side plate 2022Y in the first direction. The support portion 2024Y extends from the frame side plate 2022Y. The support portion 2024Y may be attached to the frame side plate 2022Y. The support portion 2024Y extends in the first direction. The support portion 2024Y has a circular cylindrical shape. The support portion 2024Y supports the other end of the photosensitive drum 61Y in the first direction.

The support portion 2024Y fits in the through hole 2012Y of the drum side plate 201B. The support portion 2024Y passes through the through hole 2012Y of the drum side plate 201B. The outer peripheral surface of the support portion 2024Y is located at an interval relative to the inner peripheral surface of the through hole 2012Y of the drum side plate 201B. Thus, the frame 202Y is movable relative to the drum side plate 201B.

6.1.3.5 Discharge Portion 2025Y

As shown in FIG. 11, the discharge portion 2025Y is located at the opposite side of the frame side plate 2022Y (see FIG. 10) with respect to the frame side plate 2021Y in the first direction. The discharge portion 2025Y is located away from the support portion 2023Y. The discharge portion 2025Y extends from the frame side plate 2021Y. The discharge portion 2025Y may be attached to the frame side plate 2021Y. The discharge portion 2025Y is located between the frame side plate 2021Y (see FIG. 10) and the drum side plate 201A (see FIG. 10) in the first direction. The discharge portion 2025Y extends in the first direction. In this embodiment, the discharge portion 2025Y has a circular cylindrical shape. The discharge portion 2025Y is in communication with the cleaning housing 641Y. One end of the screw 643Y in the first direction is located in the discharge portion 2025Y. The discharge portion 2025Y has a discharge port 2026Y. The screw 643Y conveys waste toner in the cleaning housing 641Y toward the discharge port 2026Y. The discharge port 2026Y discharges the toner in the cleaning housing 641Y.

6.1.4 Frames 202M, 202C, 202K

The frames 202Y, 202M, 202C, and 202K are aligned in the second direction. The description of the frame 202Y is also applied to the frames 202M, 202C, and 202K.

More specifically, as shown in FIG. 11, the frame 202M supports the photosensitive drum 61M described above and the charging device 62M (see FIG. 12). The frame 202M includes the drum cleaner 64M described above. In other words, the frame 202M includes a cleaning housing 641M as a second waste toner storage portion and a screw 643M as a second conveyance member. The screw 643M is located in the cleaning housing 641M. The frame 202M further includes a support portion 2023M (see FIG. 9), a support portion 2024M, and a discharge portion 2025M. The support portion 2024M is not shown in the drawings.

As shown in FIG. 9, the support portion 2023M supports the one end of the photosensitive drum 61M in the first direction. The support portion 2023M passes through the through hole 2011M of the drum side plate 201A. As shown in FIG. 11, the frame 202M is movable relative to the drum side plate 201A.

The support portion 2024M supports the other end of the photosensitive drum 61M in the first direction. The support portion 2024M passes through the through hole 2012M of the drum side plate 201B (see FIG. 10). The frame 202M is movable relative to the drum side plate 201B (see FIG. 10).

As shown in FIG. 11, the discharge portion 2025M has a discharge port 2026M. The screw 643M conveys waste toner in the cleaning housing 641M toward the discharge port 2026M. The discharge port 2026M discharges the waste toner in the cleaning housing 641M.

6.1.5 Elastic Members 203Y, 203M, 203C, 203K

As shown in FIG. 9, the elastic member 203Y is located between the outer peripheral surface of the support portion 2023Y and the inner peripheral surface of the through hole 2011Y. The elastic member 203Y extends in the peripheral direction of the support portion 2023Y. The elastic member 203M is located between the outer peripheral surface of the support portion 2023M and the inner peripheral surface of the through hole 2011M. The elastic member 203M extends in the peripheral direction of the support portion 2023M. The elastic member 203C is located between the outer peripheral surface of a support portion 2023C and the inner peripheral surface of the through hole 2011C. The elastic member 203C extends in the peripheral direction of the support portion 2023C. The elastic member 203K is located between the outer peripheral surface of a support portion 2023K and the inner peripheral surface of the through hole 2011K. The elastic member 203K extends in the peripheral direction of the support portion 2023K.

In this embodiment, the elastic members 203Y, 203M, 203C, and 203K are made of sponge.

6.1.6 Elastic Members 204Y, 204M, 204C, 204K

The descriptions of the elastic members 203Y, 203M, 203C, and 203K are also applied to the elastic members 204Y (see FIG. 10), 204M, 204C, and 204K. Thus, the descriptions of the elastic members 204M, 204C, and 204K will be omitted.

6.1.7 Waste Toner Pipe 205

As shown in FIG. 11, the waste toner pipe 205 is located at the lower end of the drum unit 20. The waste toner pipe 205 is attached to the lower end of the drum side plate 201A. Thus, the drum side plate 201A supports the waste toner pipe 205. The waste toner pipe 205 is located below each of the discharge portions 2025Y, 2025M, a discharge portion 2025C, and a discharge portion 2025K. The waste toner pipe 205 is located away from each of the discharge portions 2025Y, 2025M, 2025C, and 2025K in the third direction.

The waste toner pipe 205 allows passage of waste toner from the discharge portion 2025Y, passage of waste toner from the discharge portion 2025M, passage of waste toner from the discharge portion 2025C, and passage of waste toner from the discharge portion 2025K. The waste toner pipe 205 extends in the second direction. The waste toner pipe 205 has a plurality of reception ports 2051Y, 2051M, 2051C, and 2051K.

The reception ports 2051Y, 2051M, 2051C, and 2051K are aligned in the second direction. The reception port 2051Y receives waste toner discharged from the discharge port 2026Y. The reception port 2051M receives waste toner discharged from the discharge port 2026M. The reception port 2051C receives waste toner discharged from a discharge port 2026C. The reception port 2051K receives waste toner discharged from a discharge port 2026K.

6.1.8 Seal Members 206Y, 206M, 206C, 206K

The seal member 206Y is located between the discharge portion 2025Y and the waste toner pipe 205. The seal member 206Y seals between the waste toner pipe 205 and the discharge portion 2025Y. In other words, the seal member 206Y seals between the waste toner pipe 205 and the frame 202Y. The seal member 206Y extends in the third direction. One end of the seal member 206Y in the third direction contacts the discharge portion 2025Y. The other end of the seal member 206Y in the third direction contacts the waste toner pipe 205. The seal member 206Y has a through hole 2061Y. The through hole 2061Y is in communication with the discharge port 2026Y and the reception port 2051Y. In this embodiment, the seal member 206Y is made of an elastic material such as sponge.

The seal member 206M is located between the discharge portion 2025M and the waste toner pipe 205. The seal member 206M seals between the waste toner pipe 205 and the frame 202M. The seal member 206M has a through hole 2061M. The through hole 2061M is in communication with the discharge port 2026M and the reception port 2051M.

The seal member 206C is located between the discharge portion 2025C and the waste toner pipe 205. The seal member 206C seals between the waste toner pipe 205 and the frame 202C. The seal member 206C has a through hole 2061C. The through hole 2061C is in communication with the discharge port 2026C and the reception port 2051C.

The seal member 206K is located between the discharge portion 2025K and the waste toner pipe 205. The seal member 206K seals between the waste toner pipe 205 and the frame 202K. The seal member 206K has a through hole 2061K. The through hole 2061K is in communication with the discharge port 2026K and the reception port 2051K.

The description of the seal member 206Y is also applied to the seal members 206M, 206C, and 206K. Thus, the descriptions of the seal members 206M, 206C, and 206K will be omitted.

7. Detail of Drawer 30

The drawer 30 will be described in detail by referring to FIGS. 13 to 17.

Figure 13:
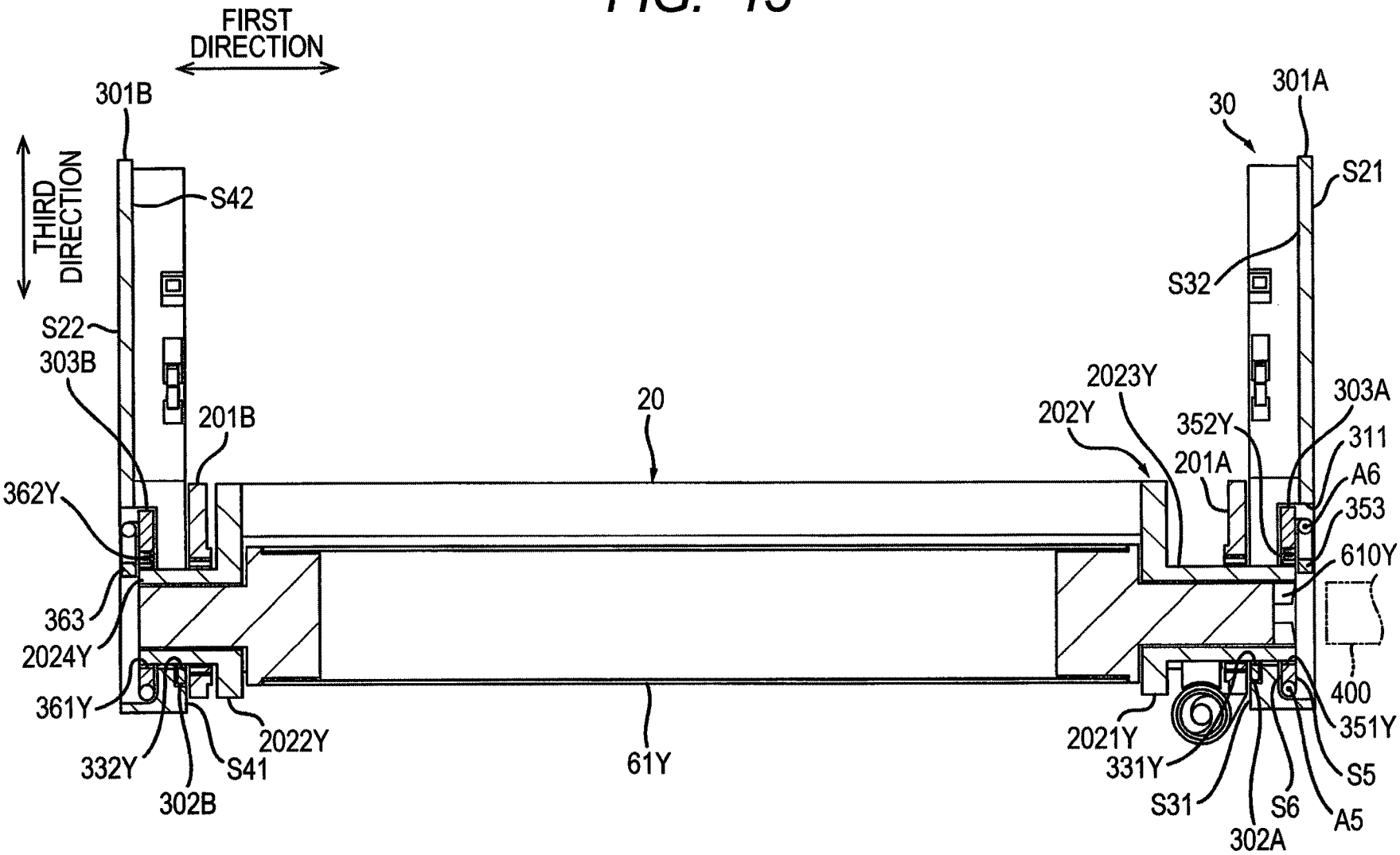
FIG. 13 is a cross-sectional view of the drawer detached from a main housing and shows a state in which the drawer is located at a lock position.
Figure 15:
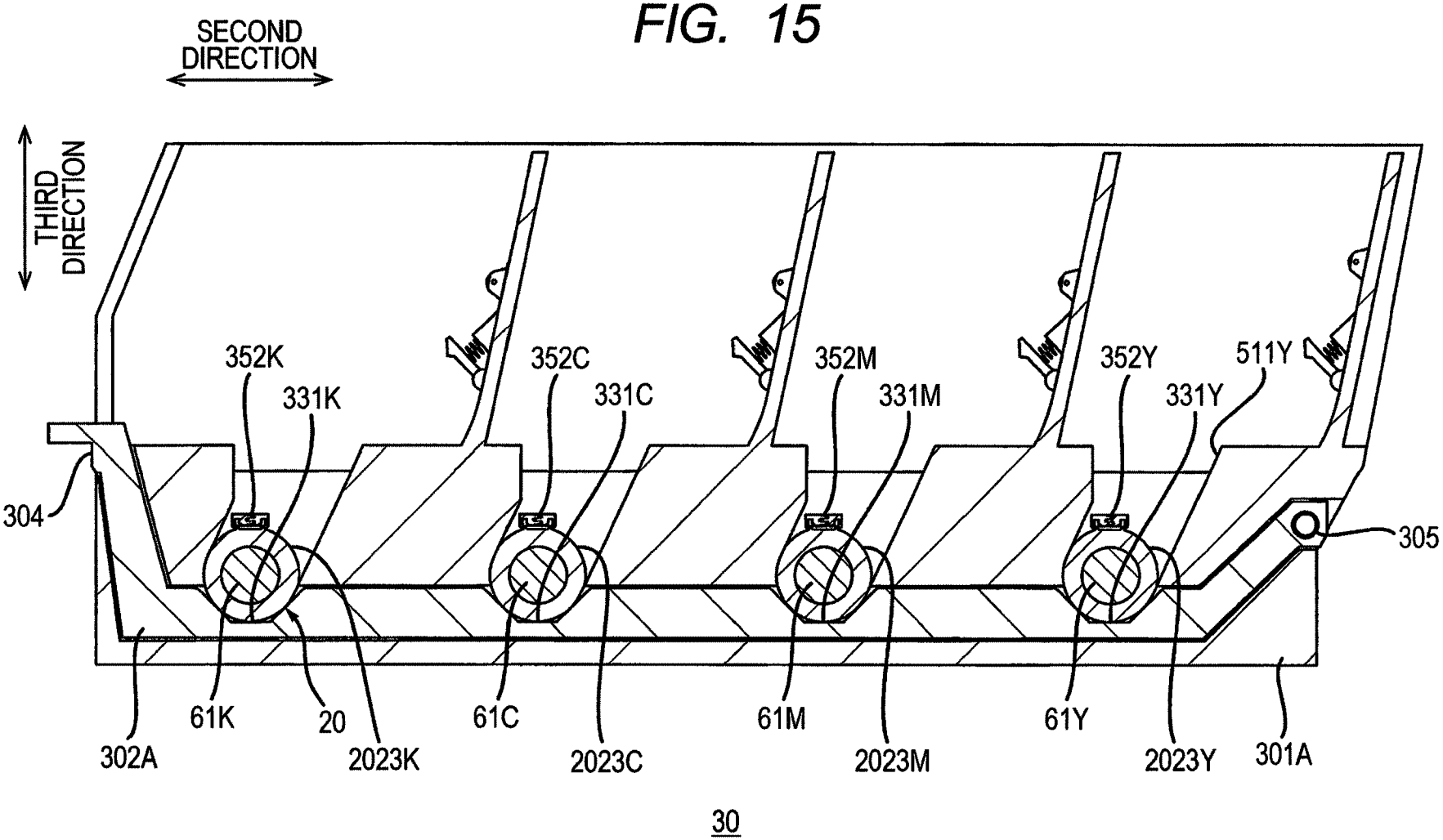
FIG. 15 is a cross-sectional view of the drawer of FIG. 13 and is a cross-sectional view through a positioning plate.

As shown in FIG. 13, the drawer 30 includes a drawer side plate 301A, a drawer side plate 301B, a positioning plate 302A, a positioning plate 302B, a lock member 303A, a lock member 303B, a first positioned portion 304 (see FIG. 15), and a second positioned portion 305 (see FIG. 15).

7.1 Drawer Side Plate 301A

Figure 16:
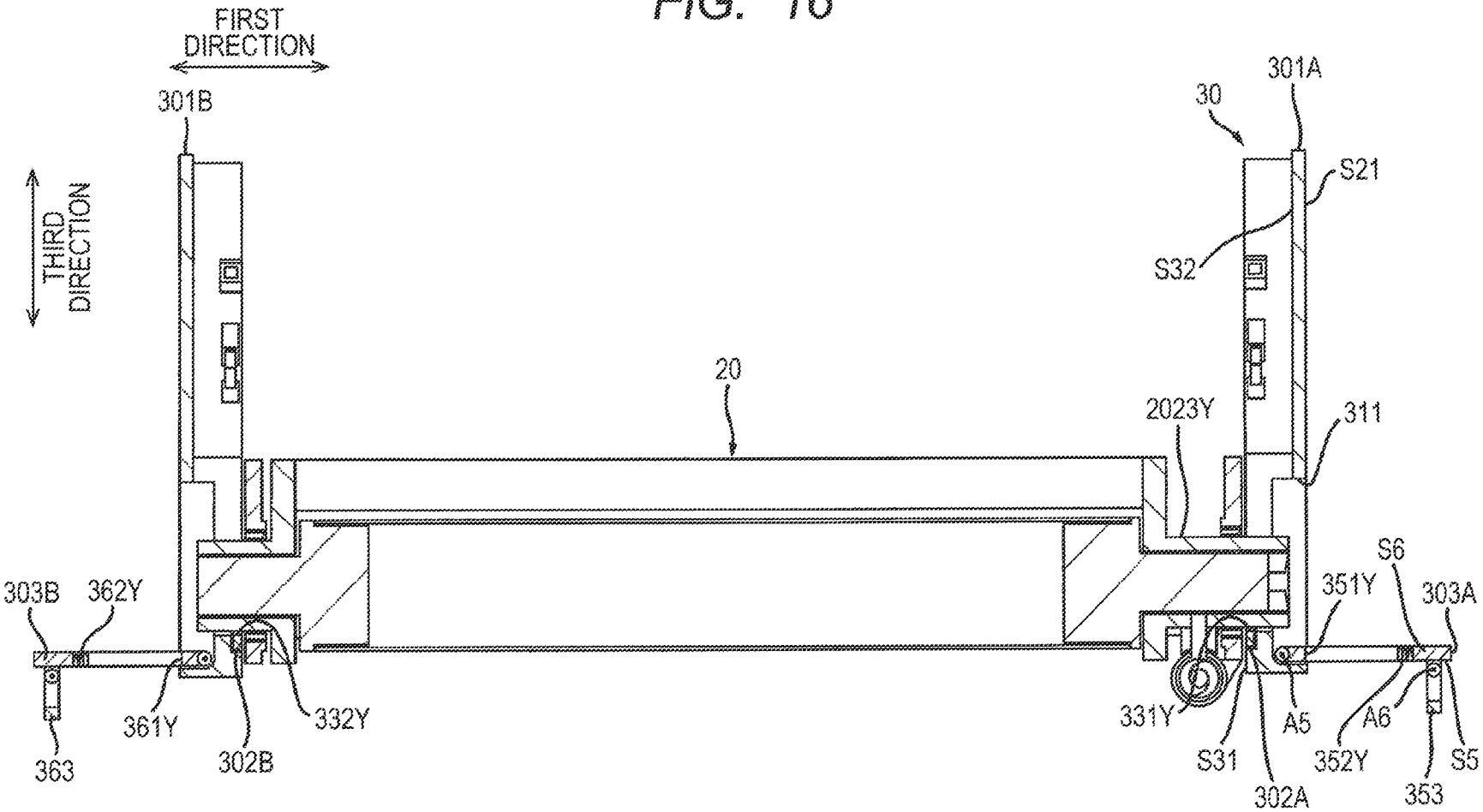
FIG. 16 is a cross-sectional view of the drawer showing a state in which the drawer is located at a lock release position.

As shown in FIG. 16, the drawer side plate 301A has a recess 311 in addition to the outer surface S21, the inner surface S31, and the inner surface S32 described above.

Figure 17:
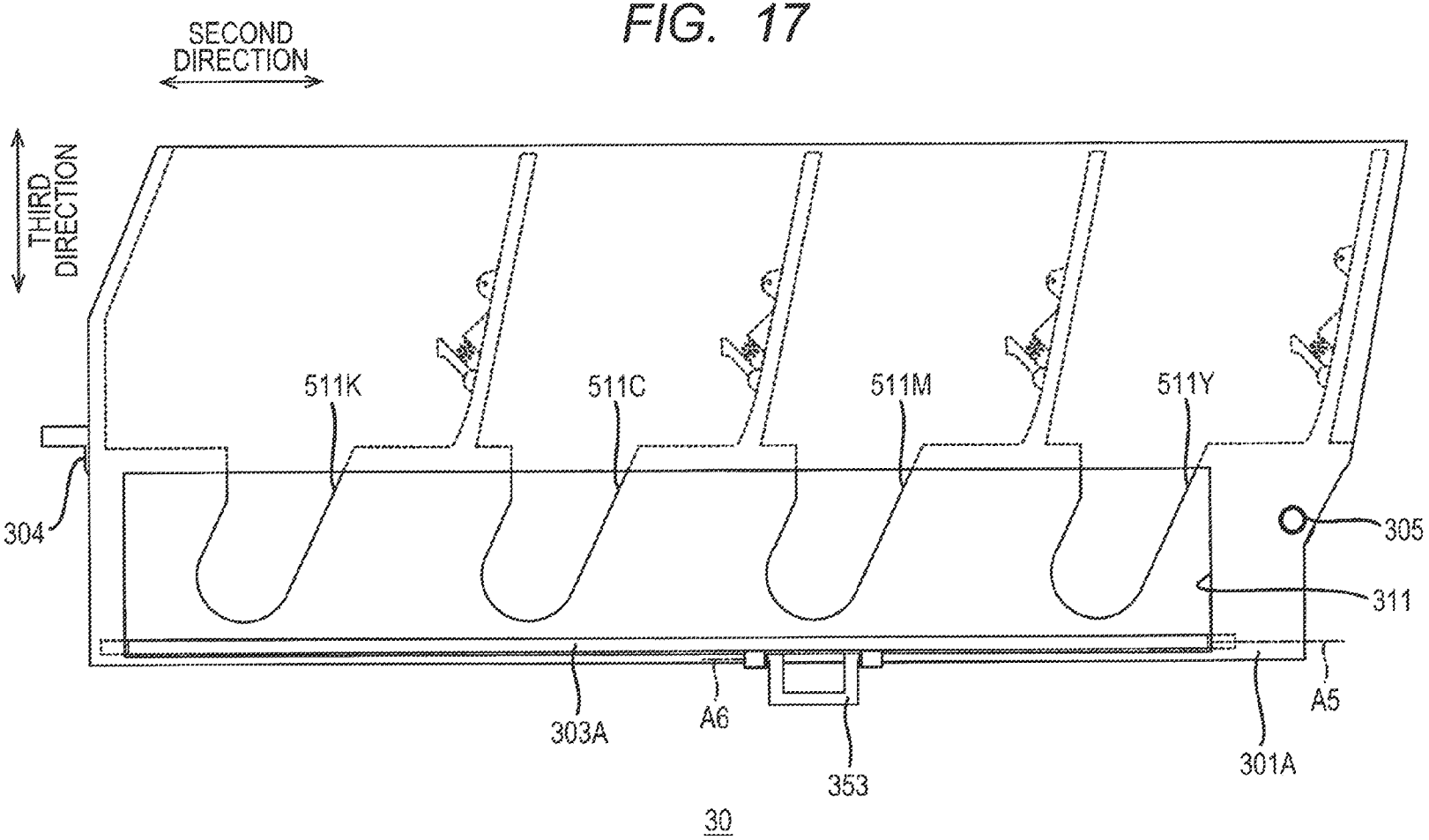
FIG. 17 is a side view of the drawer of FIG. 15.

The recess 311 is recessed from the outer surface S21 toward the inner surface S31 in the first direction. As shown in FIG. 17, the recess 311 is in communication with the lower end of each of the drum guides 511Y, 511M, 511C, and 511K.

Figure 14:
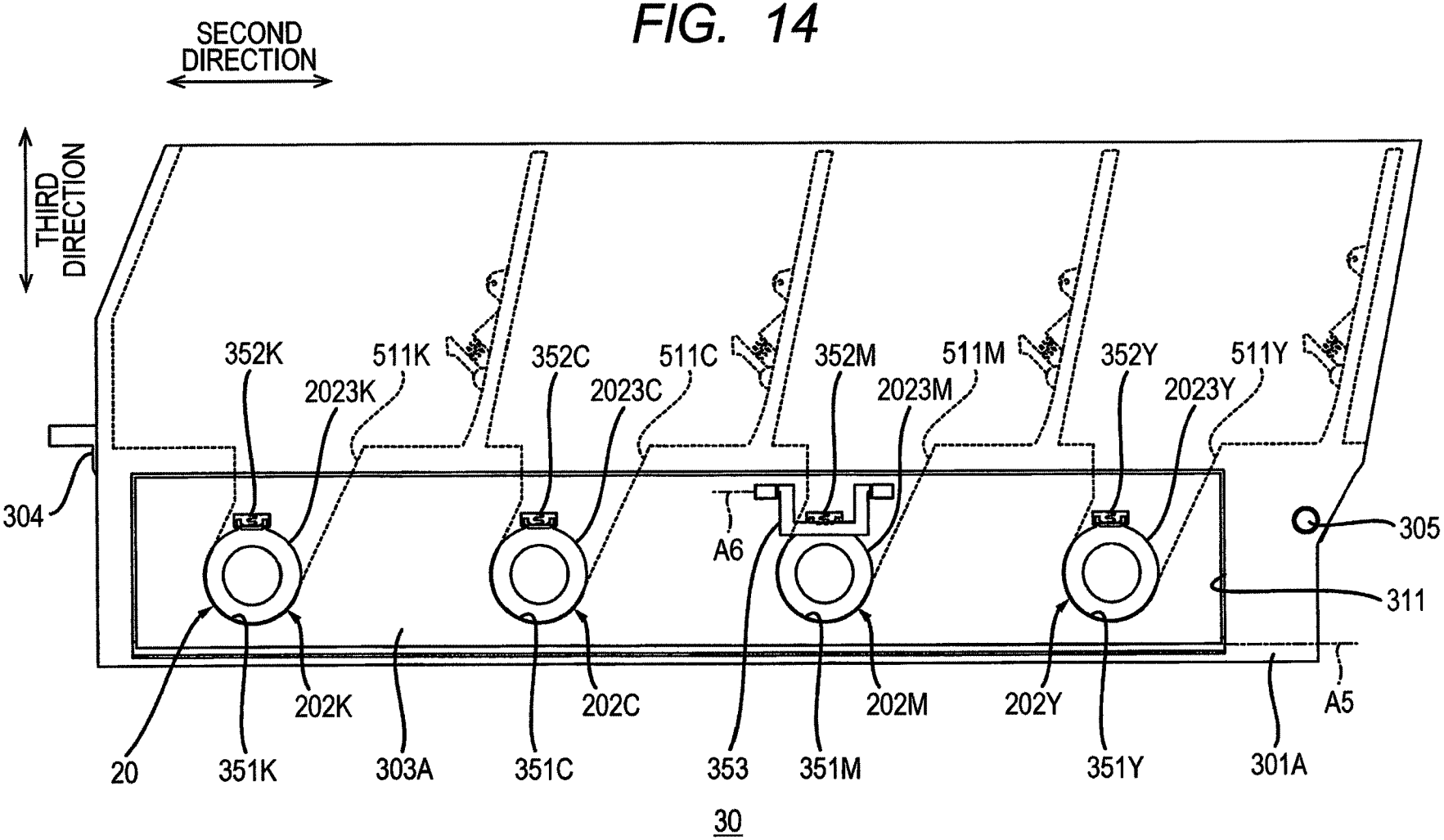
FIG. 14 is a side view of the drawer of FIG. 13.

As shown in FIG. 14, in this embodiment, when the drum unit 20 is attached to the drawer 30, the drum guide 511Y guides the support portion 2023Y. In a state where the drum unit 20 is attached to the drawer 30, the support portion 2023Y fits in the drum guide 511Y.

The description of the drum guide 511Y is also applied to the drum guides 511M, 511C, and 511K. Thus, the descriptions of the drum guides 511M, 511C, and 511K will be omitted.

7.2 Drawer Side Plate 301B

As shown in FIG. 13, the drawer side plate 301B is located away from the drawer side plate 301A in the first direction.

The description of the drawer side plate 301A is also applied to the drawer side plate 301B. Thus, the description of the drawer side plate 301B will be omitted.

7.3 Positioning Plate 302A

The positioning plate 302A is located at the inner surface S31 of the drawer side plate 301A. The positioning plate 302A is attached to the inner surface S31 of the drawer side plate 301A. In a state where the drum unit 20 is attached to the drawer 30, the positioning plate 302A is located at the opposite side of the frame side plate 2021Y with respect to the drum side plate 201A in the first direction.

As shown in FIG. 15, the positioning plate 302A extends in the second direction. In this embodiment, the positioning plate 302A is made of metal such as iron or stainless steel. The positioning plate 302A has a plurality of recesses 331Y, 331M, 331C, and 331K.

In a state where the drum unit 20 is attached to the drawer 30, the support portion 2023Y fits in the recess 331Y, the support portion 2023M fits in the recess 331M, the support portion 2023C fits in the recess 331C, and the support portion 2023K fits in the recess 331K.

In a state where the drum unit 20 is attached to the drawer 30, the positioning plate 302A contacts the support portion 2023Y, thereby positioning the support portion 2023Y relative to the drawer 30. Thus, in a state where the drum unit 20 is attached to the drawer 30, the positioning plate 302A positions the photosensitive drum 61Y relative to the drawer 30.

In a state where the drum unit 20 is attached to the drawer 30, the positioning plate 302A contacts the support portion 2023M, thereby positioning the support portion 2023M relative to the drawer 30. Thus, in a state where the drum unit 20 is attached to the drawer 30, the positioning plate 302A positions the photosensitive drum 61M relative to the drawer 30.

In a state where the drum unit 20 is attached to the drawer 30, the positioning plate 302A contacts the support portion 2023C, thereby positioning the support portion 2023C relative to the drawer 30. Thus, in a state where the drum unit 20 is attached to the drawer 30, the positioning plate 302A positions the photosensitive drum 61C relative to the drawer 30.

In a state where the drum unit 20 is attached to the drawer 30, the positioning plate 302A contacts the support portion 2023K, thereby positioning the support portion 2023K relative to the drawer 30. Thus, in a state where the drum unit 20 is attached to the drawer 30, the positioning plate 302A positions the photosensitive drum 61K relative to the drawer 30.

7.4 Positioning Plate 302B

As shown in FIG. 13, the positioning plate 302B is located away from the positioning plate 302A in the first direction. The positioning plate 302B is located at the inner surface S41 of the drawer side plate 301B. The positioning plate 302B is attached to the inner surface S41 of the drawer side plate 301B. In a state where the drum unit 20 is attached to the drawer 30, the positioning plate 302B is located at the opposite side of the frame side plate 2022Y with respect to the drum side plate 201B in the first direction. In a state where the drum unit 20 is attached to the drawer 30, the positioning plate 302B is located at the opposite side of the positioning plate 302A with respect to the photosensitive drums 61Y, 61M, 61C, and 61K (see FIG. 12) in the first direction.

The positioning plate 302B extends in the second direction. In this embodiment, the positioning plate 302B has the same shape as the positioning plate 302A. The positioning plate 302B may have a different shape from the positioning plate 302A. The positioning plate 302B has a plurality of recesses 332Y, 332M, 332C, and 332K. The recesses 332M, 332C, and 332K are not shown in the drawings.

In a state where the drum unit 20 is attached to the drawer 30, the support portion 2024Y fits in the recess 332Y, the support portion 2024M fits in the recess 332M, a support portion 2024C fits in the recess 332C, and a support portion 2024K fits in the recess 332K. Thus, in cooperation with the positioning plate 302A, the positioning plate 302B positions the photosensitive drums 61Y, 61M, 61C, and 61K relative to the drawer 30.

7.5 Lock Member 303A

The lock member 303A is attached to the outer surface S21 of the drawer side plate 301A. As shown in FIGS. 13 and 16, in a state where the drum unit 20 is attached to the drawer 30, the lock member 303A is movable between a lock position (see FIG. 13) and a lock release position (see FIG. 16). The lock member 303A is rotationally movable between the lock position (see FIG. 13) and the lock release position (see FIG. 16) about an axis A5. The axis A5 extends in a direction in which the drawer 30 moves from the accommodated position (see FIG. 1) to the pulled-out position (see FIG. 2).

As shown in FIG. 13, in a state where the lock member 303A is located at the lock position, the lock member 303A locks the drum unit 20 on the drawer 30. In a state where the lock member 303A is located at the lock position, the lock member 303A is located in the recess 311. In a state where the lock member 303A is located at the lock position, the lock member 303A extends in the third direction.

As shown in FIG. 16, in a state where the lock member 303A is located at the lock release position, the lock member 303A releases lock of the drum unit 20 relative to the drawer 30. In a state where the lock member 303A is located at the lock release position, a part of the lock member 303A is located outside the recess 311. In a state where the lock member 303A is located at the lock release position, the lock member 303A extends in the first direction.

As shown in FIG. 14, the lock member 303A extends in the second direction. The lock member 303A has a plate shape. As shown in FIG. 13, the lock member 303A has a first surface S5 and a second surface S6. In a state where the lock member 303A is located at the lock position, the second surface S6 is located between the drum side plate 201A and the first surface S5 in the first direction. As shown in FIG. 14, the lock member 303A has a plurality of holes 351Y, 351M, 351C, and 351K, a plurality of drum pressing members 352Y, 352M, 352C, and 352K, and a handle 353.

7.5.1 Holes 351Y, 351M, 351C, 351K

The holes 351Y, 351M, 351C, and 351K are aligned in the second direction. Each of the holes 351Y, 351M, 351C, and 351K has a circular shape. In this embodiment, each of the holes 351Y, 351M, 351C, and 351K is a through hole.

As shown in FIG. 13, in a state where the drum unit 20 is attached to the drawer 30 and the lock member 303A is located at the lock position, the support portion 2023Y of the frame 202Y fits in the hole 351Y. In a state where the lock member 303A is located at the lock position, the support portion 2023Y passes through the hole 351Y. In a state where the drum unit 20 is attached to the drawer 30 and the lock member 303A is located at the lock position, a coupling 610Y of the photosensitive drum 61Y is exposed through the hole 351Y. The coupling 610Y is located at the one end of the photosensitive drum 61Y in the first direction. The photosensitive drum 61Y includes the coupling 610Y. In a state where the drawer 30 is located at the accommodated position, a main body coupling 400 fits in the coupling 610Y.

As shown in FIG. 14, in a state where the drum unit 20 is attached to the drawer 30 and the lock member 303A is located at the lock position, the support portion 2023M of the frame 202M fits in the hole 351M, the support portion 2023C of the frame 202C fits in the hole 351C, and the support portion 2023K of the frame 202K fits in the hole 351K.

The description of the hole 351Y is also applied to the holes 351M, 351C, and 351K. Thus, the descriptions of the holes 351M, 351C, and 351K will be omitted.

7.5.2 Drum Pressing Members 352Y, 352M, 352C, 352K

As shown in FIG. 14, the drum pressing member 352Y is located at the upper end of the hole 351Y. The drum pressing member 352M is located at the upper end of the hole 351M. The drum pressing member 352C is located at the upper end of the hole 351C. The drum pressing member 352K is located at the upper end of the hole 351K.

As shown in FIG. 15, in a state where the drum unit 20 is attached to the drawer 30 and the lock member 303A is located at the lock position, the drum pressing member 352Y presses the support portion 2023Y toward the recess 331Y of the positioning plate 302A, the drum pressing member 352M presses the support portion 2023M toward the recess 331M of the positioning plate 302A, the drum pressing member 352C presses the support portion 2023C toward the recess 331C of the positioning plate 302A, and the drum pressing member 352K presses the support portion 2023K toward the recess 331K of the positioning plate 302A. Thus, in a state where the drum unit 20 is attached to the drawer 30 and the lock member 303A is located at the lock position, the lock member 303A presses the support portions 2023Y, 2023M, 2023C, and 2023K toward the positioning plate 302A.

In this embodiment, each of the drum pressing members 352Y, 352M, 352C, and 352K is a spring.

7.5.3 Handle 353

As shown in FIG. 13, the handle 353 is attached to the first surface S5 of the lock member 303A. The handle 353 may extend from the first surface S5. The handle 353 is rotationally movable about an axis A6. The axis A6 extends parallel to the axis A5. In a state where the lock member 303A is located at the lock position, the handle 353 is located away from the axis A5 in the third direction. In a state where the lock member 303A is located at the lock position, the handle 353 is attached to the opposite side of the axis A5 with respect to the hole 351Y in the third direction.

7.6 Lock Member 303B

The lock member 303B is attached to the drawer side plate 301B. The lock member 303B is attached to the outer surface S22 of the drawer side plate 301B.

The description of the lock member 303A is also applied to the lock member 303B.

More specifically, the lock member 303B has a plurality of holes 361Y, 361M, 361C, and 361K, a plurality of drum pressing members 362Y, 362M, 362C, and 362K, and a handle 363. The holes 361M, 361C, and 361K, and the drum pressing members 362M, 362C, and 362K are not shown in the drawings.

As shown in FIGS. 13 and 16, in a state where the drum unit 20 is attached to the drawer 30, the lock member 303B is movable between a second lock position (see FIG. 13) and a second lock release position (see FIG. 16). As shown in FIG. 13, in a state where the lock member 303B is at the second lock position, the lock member 303B locks the drum unit 20 on the drawer 30. As shown in FIG. 16, in a state where the lock member 303B is located at the second lock release position, the lock member 303B releases lock of the drum unit 20 relative to the drawer 30.

More specifically, as shown in FIG. 13, in a state where the drum unit 20 is attached to the drawer 30 and the lock member 303B is located at the second lock position, the support portion 2024Y fits in the hole 361Y, the support portion 2024M fits in the hole 361M, the support portion 2024C fits in the hole 361C, and the support portion 2024K fits in the hole 361K. Thus, in a state where the drum unit 20 is attached to the drawer 30 and the lock member 303B is located at the second lock position, the lock member 303B presses the support portions 2024Y, 2024M, 2024C, and 2024K toward the positioning plate 302B.

7.7 First Positioned Portion 304

As shown in FIG. 15, the first positioned portion 304 is located at one end of the drawer 30 in the second direction. The first positioned portion 304 is a cutout. More specifically, the first positioned portion 304 is located at one end of the positioning plate 302A in the second direction. In other words, the positioning plate 302A includes the first positioned portion 304. The positioning plate 302B (see FIG. 18) also includes the first positioned portion 304.

7.8 Second Positioned Portion 305

The second positioned portion 305 is located at the other end of the drawer 30 in the second direction. The second positioned portion 305 has a circular columnar shape. The second positioned portion 305 extends in the first direction. The second positioned portion 305 is made of metal such as iron or stainless steel. The second positioned portion 305 is connected to the positioning plate 302A. The second positioned portion 305 protrudes from the outer surface S21 of the drawer side plate 301A in the first direction. The second positioned portion 305 is also connected to the positioning plate 302B (see FIG. 13).

8. Detail of Main Housing 40

Figure 18:
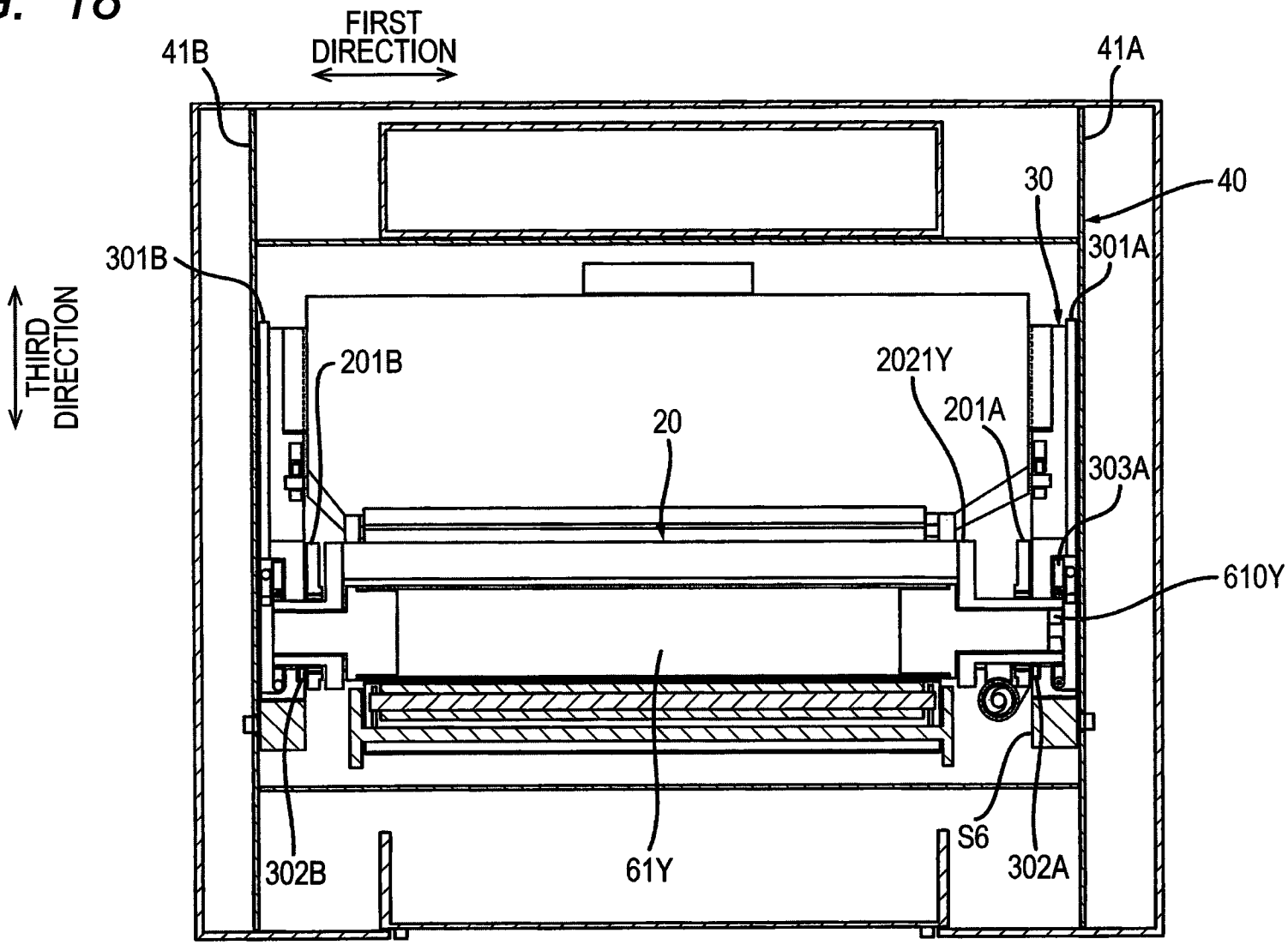
FIG. 18 is a cross-sectional view of the image forming apparatus of the second embodiment.
Figure 19:
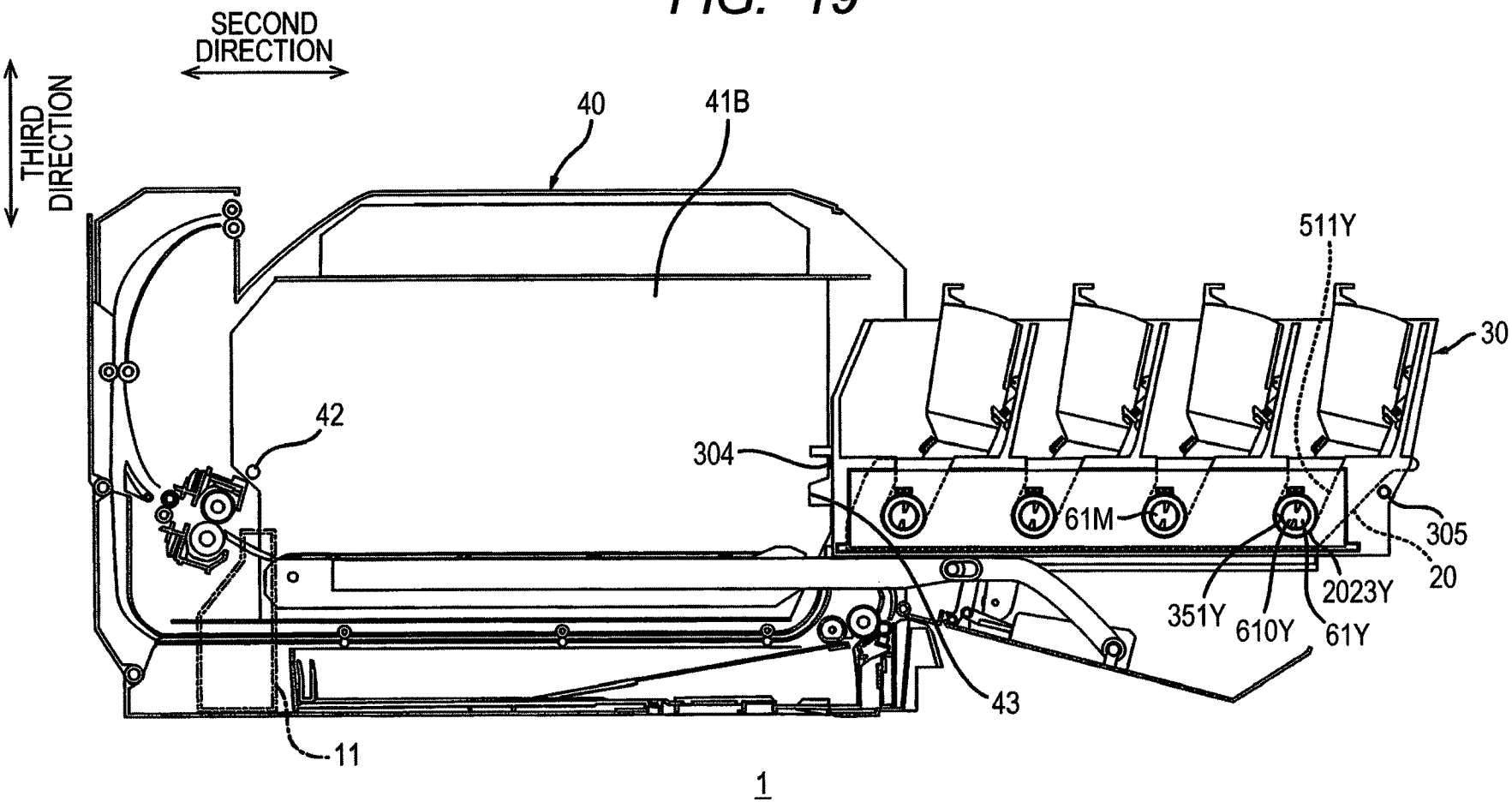
FIG. 19 shows a state in which the drawer of FIG. 20 is located at the pulled-out position.

The main housing 40 includes a side plate 41A (see FIG. 18), a side plate 41B (see FIG. 18), a first positioning member 42 (see FIG. 19), and a second positioning member 43 (see FIG. 19).

8.1 Side Plate 41A

As shown in FIG. 18, the side plate 41A is located in the main housing 40. In a state where the drawer 30 is located at the accommodated position, the side plate 41A faces the drawer side plate 301A. The side plate 41A is made of metal such as iron or stainless steel. The side plate 41A extends in the third direction and in the second direction (see FIG. 19).

8.2 Side Plate 41B

The side plate 41B is located in the main housing 40. The side plate 41B is located away from the side plate 41A in the first direction. In a state where the drawer 30 is located at the accommodated position, the side plate 41B is located at the opposite side of the side plate 41A with respect to the drawer 30. In a state where the drawer 30 is located at the accommodated position, the side plate 41B faces the drawer side plate 301B. The side plate 41B is made of metal such as iron or stainless steel. The side plate 41B extends in the third direction. As shown in FIG. 19, the side plate 41B extends in the second direction.

8.3 First Positioning Member 42

The first positioning member 42 is located at one end of the side plate 41B in the second direction. The first positioning member 42 extends in the first direction. The first positioning member 42 has a circular columnar shape. In this embodiment, the first positioning member 42 is attached to the side plate 41B. The first positioning member 42 may extend from the side plate 41B. The first positioning member 42 is also located at the side plate 41A (see FIG. 18).

Figure 20:
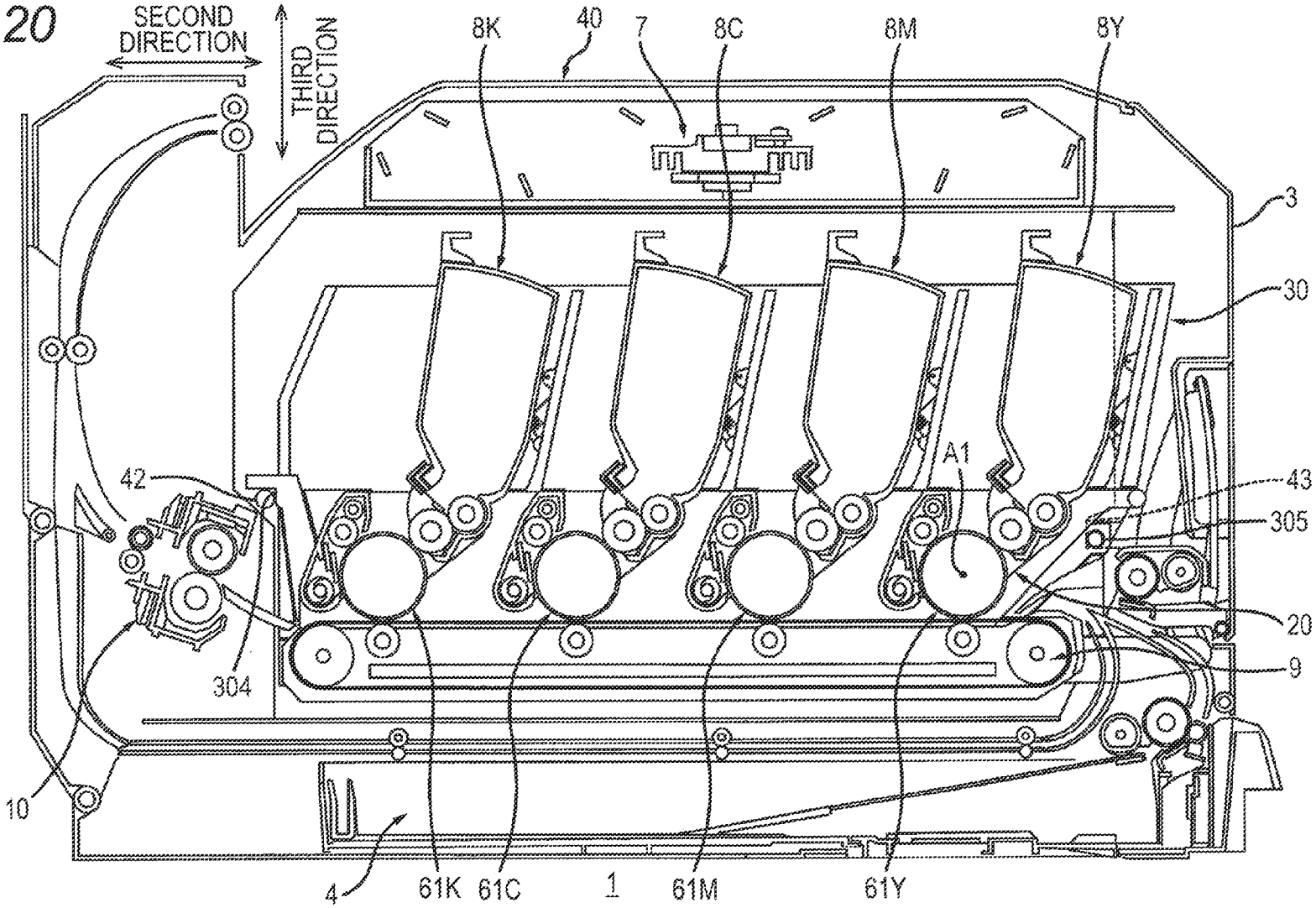
FIG. 20 is a diagram showing the schematic configuration of the image forming apparatus.

As shown in FIG. 20, in a state where the drawer 30 is located at the accommodated position, the first positioning member 42 fits in the first positioned portion 304. Thus, in a state where the drawer 30 is located at the accommodated position, the first positioned portion 304 is positioned by the first positioning member 42. In a state where the drawer 30 is located at the accommodated position, the first positioning member 42 positions one end of the drawer 30 in the movement direction of the drawer 30 relative to the main housing 40.

As shown in FIG. 19, in a state where the drawer 30 is located at the pulled-out position, the first positioned portion 304 is separated from the first positioning member 42.

8.4 Second Positioning Member 43

The second positioning member 43 is located at the other end of the side plate 41B in the second direction. The second positioning member 43 is a cutout. More specifically, in this embodiment, the second positioning member 43 is provided at the side plate 41B. In other words, the side plate 41B has the second positioning member 43. The side plate 41A (see FIG. 18) also has the second positioning member 43.

As shown in FIG. 20, in a state where the drawer 30 is located at the accommodated position, the second positioned portion 305 fits in the second positioning member 43. Thus, in a state where the drawer 30 is located at the accommodated position, the second positioned portion 305 is positioned by the second positioning member 43. In a state where the drawer 30 is located at the accommodated position, the second positioning member 43 positions the other end of the drawer 30 in the movement direction of the drawer 30 relative to the main housing 40.

As shown in FIG. 19, in a state where the drawer 30 is located at the pulled-out position, the second positioned portion 305 is separated from the second positioning member 43.

9. Operations and Effects of Second Embodiment (1) In image forming apparatus 1, as shown in FIG. 19, in a state where the drawer 30 is located at the pulled-out position and the drum unit 6 is attached to the drawer 5, the photosensitive drum 61Y and the photosensitive drum 61M are positioned by the positioning plate 302A (see FIG. 15).

And, as shown in FIG. 20, by moving the drawer 30 from the pulled-out position to the accommodated position, the photosensitive drum 61Y and the photosensitive drum 61M are accommodated in the main housing 40 in a state where the photosensitive drum 61Y and the photosensitive drum 61M are positioned.

Thus, compared with the first embodiment (see FIG. 4) in which the photosensitive drum 61Y and the photosensitive drum 61M are positioned relative to the positioning plate 22A in the main housing 2 when the drawer 5 is located at the accommodated position, in the image forming apparatus 1 of the second embodiment, the photosensitive drum 61Y and the photosensitive drum 61M can be smoothly positioned relative to the main housing 40.

(2) In the image forming apparatus 1, as shown in FIG. 19, when the drum unit 20 is detached from the drawer 30 in a state where the drawer 30 is located at the pulled-out position, the leakage of waste toner from the frame 202Y and the frame 202M can be suppressed by the seal member 206Y and the seal member 206M (See FIG. 11).

10. Modifications

While the disclosure has been described in detail with reference to the above aspects thereof, it would be apparent to those skilled in the art that various changes and modifications may be made therein without departing from the scope of the claims.

(1) The cartridge 8Y may be a toner cartridge that does not have the development roller 81Y. In this case, the drum unit 20 may have a developing device having the development roller 81Y.

(2) The transfer device 9 may be an intermediate transfer type.

(3) The cartridge 8Y may not have the ribs 83Y1 and 83Y2. In this case, the rib 52Y of the drawer 5 may support the one end of the cartridge housing 82Y in the first direction. The one end of the cartridge housing 82Y may be a gear cover. The rib 53Y of the drawer 5 may support the other end of the cartridge housing 82Y in the first direction. The other end of the cartridge housing 82Y may be a gear cover.

(4) The cartridge 8Y may not have the protrusions 84Y1 and 84Y2. In this case, the development pressing member 54Y of the drawer 5 may press the one end of the cartridge housing 82Y in the first direction. The one end of the cartridge housing 82Y may be a gear cover. The development pressing member 54Y of the drawer 5 may press the other end of the cartridge housing 82Y in the first direction. The other end of the cartridge housing 82Y may be a gear cover.

What is claimed is:

1. An image forming apparatus comprising:

a main housing;

a drawer movable between an accommodated position at which the drawer is accommodated in the main housing and a pulled-out position at which the drawer is pulled out from the main housing; and a drum unit attachable to the drawer in a state where the drawer is located at the pulled-out position, the drum unit including:

a first photosensitive drum;

a second photosensitive drum; and a waste toner pipe allowing passage of waste toner from the first photosensitive drum and waste toner from the second photosensitive drum.

2. The image forming apparatus according to claim 1, wherein the first photosensitive drum is rotatable about a first axis extending in a first direction;

wherein the drum unit includes:

a first drum side plate supporting one end of the first photosensitive drum in the first direction; and a second drum side plate supporting an other end of the first photosensitive drum in the first direction; and wherein the waste toner pipe is located between the first drum side plate and the second drum side plate in the first direction.

3. The image forming apparatus according to claim 2, wherein, in a state where the drum unit is attached to the drawer, a part of the waste toner pipe is located below the first drum side plate.

4. The image forming apparatus according to claim 1, wherein the first photosensitive drum is rotatable about a first axis extending in a first direction;

wherein the main housing includes:

a first positioning plate positioning one end of the first photosensitive drum in the first direction relative to the main housing in a state where the drum unit is attached to the drawer and the drawer is located at the accommodated position; and a second positioning plate positioning an other end of the first photosensitive drum in the first direction relative to the main housing in a state where the drum unit is attached to the drawer and the drawer is located at the accommodated position; and wherein, in a state where the drum unit is attached to the drawer and the drawer is located at the accommodated position, the waste toner pipe is located between the first positioning plate and the second positioning plate in the first direction.

5. The image forming apparatus according to claim 1, further comprising:

a first cartridge storing toner to be supplied to the first photosensitive drum, the first cartridge being attachable to the drawer in a state where the drawer is located at the pulled-out position; and a second cartridge storing toner to be supplied to the second photosensitive drum, the second cartridge being attachable to the drawer in a state where the drawer is located at the pulled-out position.

6. The image forming apparatus according to claim 5, wherein the drum unit includes:

a first cartridge guide configured to guide the first cartridge; and a second cartridge guide configured to guide the second cartridge.

7. The image forming apparatus according to claim 5, wherein the drawer includes a drum guide configured to guide the drum unit.

8. The image forming apparatus according to claim 5, wherein the first photosensitive drum is rotatable about a first axis extending in a first direction;

wherein the drawer includes:

a first drawer side plate supporting one end of the drum unit in the first direction in a state where the drum unit is attached to the drawer;

a second drawer side plate supporting an other end of the drum unit in the first direction in a state where the drum unit is attached to the drawer;

wherein the first drawer side plate includes:

a first inner surface facing the one end of the drum unit in the first direction in a state where the drum unit is attached to the drawer; and a second inner surface facing one end of the first cartridge in the first direction in a state where the first cartridge is attached to the drawer; and wherein the second drawer side plate includes:

a third inner surface facing the other end of the drum unit in the first direction in a state where the drum unit is attached to the drawer; and a fourth inner surface facing an other end of the first cartridge in the first direction in a state where the first cartridge is attached to the drawer.

9. The image forming apparatus according to claim 8, wherein a distance between the second inner surface and the fourth inner surface in the first direction is greater than a distance between the first inner surface and the third inner surface in the first direction.

10. The image forming apparatus according to claim 8, wherein the drawer includes:

a first rib located at the second inner surface of the first drawer side plate, the first rib supporting the one end of the first cartridge in the first direction in a state where the first cartridge is attached to the drawer; and a second rib located at the fourth inner surface of the second drawer side plate, the second rib supporting the other end of the first cartridge in the first direction in a state where the first cartridge is attached to the drawer.

11. The image forming apparatus according to claim 10, wherein the drum unit includes:

a first drum side plate supporting one end of the first photosensitive drum in the first direction; and a second drum side plate supporting an other end of the first photosensitive drum in the first direction;

wherein the first rib is located at an opposite side of the second drum side plate with respect to the first drum side plate in the first direction; and wherein the second rib is located at an opposite side of the first drum side plate with respect to the second drum side plate in the first direction.

12. The image forming apparatus according to claim 10, wherein the first cartridge includes:

a first development roller in contact with the first photosensitive drum in a state where the drum unit is attached to the drawer and the first cartridge is attached to the drawer; and wherein the drawer includes:

a first development pressing member configured to press the one end of the first cartridge in the first direction toward the first photosensitive drum; and a second development pressing member configured to press the other end of the first cartridge in the first direction toward the first photosensitive drum.

13. The image forming apparatus according to claim 12, wherein the first development pressing member is attached to the first rib; and wherein the second development pressing member is attached to the second rib.

14. The image forming apparatus according to claim 13, wherein the drum unit includes:

a first drum side plate supporting one end of the first photosensitive drum in the first direction; and a second drum side plate supporting an other end of the first photosensitive drum in the first direction;

wherein the first development pressing member is located at an opposite side of the second drum side plate with respect to the first drum side plate in the first direction; and wherein the second development pressing member is located at an opposite side of the first drum side plate with respect to the second drum side plate in the first direction.

15. The image forming apparatus according to claim 10, wherein the first rib includes a first protrusion in contact with the one end of the first cartridge in the first direction in a state where the first cartridge is attached to the drawer; and wherein the second rib includes a second protrusion in contact with the other end of the first cartridge in the first direction in a state where the first cartridge is attached to the drawer.

16. The image forming apparatus according to claim 1, wherein the drawer includes:

a sheet guide configured to guide a sheet conveyed toward the first photosensitive drum in a state where the drum unit is attached to the drawer and the drawer is located at the accommodated position.

17. The image forming apparatus according to claim 1, wherein the drum unit includes a waste toner pipe allowing passage of waste toner from the first photosensitive drum and waste toner from the second photosensitive drum;

wherein the image forming apparatus further includes a waste-toner storage portion configured to store the waste toner; and wherein the waste toner pipe is configured to:

be connected to the waste-toner storage portion in a state where the drawer is located at the accommodated position; and be separated from the waste-toner storage portion in a state where the drawer is located at the pulled-out position.

18. An image forming apparatus comprising:

a main housing;

a drawer movable between an accommodated position at which the drawer is accommodated in the main housing and a pulled-out position at which the drawer is pulled out from the main housing; and a drum unit including a first photosensitive drum and a second photosensitive drum, the drum unit being attachable to the drawer in a state where the drawer is located at the pulled-out position, the drawer including a positioning plate positioning the first photosensitive drum and the second photosensitive drum relative to the drawer in a state where the drum unit is attached to the drawer.

19. The image forming apparatus according to claim 18, wherein the drum unit includes:

a first frame supporting the first photosensitive drum;

a second frame supporting the second photosensitive drum; and a drum side plate supporting the first frame and the second frame; and wherein each of the first frame and the second frame is movable relative to the drum side plate.

20. The image forming apparatus according to claim 19, wherein the first photosensitive drum is rotatable about a first axis extending in a first direction;

wherein the second photosensitive drum is rotatable about a second axis extending in the first direction;

wherein the first frame includes a first support portion supporting one end of the first photosensitive drum in the first direction;

wherein the second frame includes a second support portion supporting one end of the second photosensitive drum in the first direction; and wherein, in a state where the drum unit is attached to the drawer, the positioning plate contacts the first support portion and the second support portion, thereby positioning the first support portion and the second support portion relative to the drawer.

21. The image forming apparatus according to claim 20, wherein the drum side plate has a first through hole through which the first support portion passes and a second through hole through which the second support portion passes; and wherein the drum unit includes:

a first elastic member located between an outer peripheral surface of the first support portion and an inner peripheral surface of the first through hole; and a second elastic member located between an outer peripheral surface of the second support portion and an inner peripheral surface of the second through hole.

22. The image forming apparatus according to claim 20, wherein the drawer further includes:

a lock member movable between a lock position at which the drum unit is locked on the drawer and a lock release position at which lock of the drum unit on the drawer is released in a state where the drum unit is attached to the drawer; and wherein, in a state where the drum unit is attached to the drawer and the lock member is located at the lock position, the lock member presses the first support portion and the second support portion toward the positioning plate.

23. The image forming apparatus according to claim 22, wherein the lock member is rotationally movable between the lock position and the lock release position about an axis extending in a direction in which the drawer moves from the accommodated position to the pulled-out position.

24. The image forming apparatus according to claim 22, wherein the lock member has a plate shape.

25. The image forming apparatus according to claim 22, wherein the lock member includes:

a first drum pressing member configured to press the first support portion toward the positioning plate in a state where the drum unit is attached to the drawer and the lock member is located at the lock position; and a second drum pressing member configured to press the second support portion toward the positioning plate in a state where the drum unit is attached to the drawer and the lock member is located at the lock position.

26. The image forming apparatus according to claim 25, wherein each of the first drum pressing member and the second drum pressing member is a spring.

27. The image forming apparatus according to claim 22, wherein the lock member has:

a first hole in which the first support portion fits in a state where the drum unit is attached to the drawer and the lock member is located at the lock position; and a second hole in which the second support portion fits in a state where the drum unit is attached to the drawer and the lock member is located at the lock position.

28. The image forming apparatus according to claim 19, wherein the first photosensitive drum is rotatable about a first axis extending in a first direction;

wherein the drawer includes a second positioning plate located at an opposite side of the positioning plate with respect to the first photosensitive drum and the second photosensitive drum in the first direction in a state where the drum unit is attached to the drawer, the second positioning plate positioning the first photosensitive drum and the second photosensitive drum relative to the drawer in cooperation with the positioning plate;

wherein the first frame includes a first support portion supporting an other end of the first photosensitive drum in the first direction;

wherein the second frame includes a second support portion supporting an other end of the second photosensitive drum in the first direction;

wherein the second positioning plate positions the first support portion and the second support portion relative to the drawer in a state where the drum unit is attached to the drawer;

wherein the drawer further includes:

a lock member movable between a lock position at which the drum unit is locked on the drawer and a lock release position at which lock of the drum unit on the drawer is released in a state where the drum unit is attached to the drawer; and wherein, in a state where the drum unit is attached to the drawer and the lock member is located at the lock position, the lock member presses the first support portion and the second support portion toward the second positioning plate.

29. The image forming apparatus according to claim 28, wherein the lock member includes:

a first drum pressing member configured to press the first support portion toward the second positioning plate in a state where the drum unit is attached to the drawer and the lock member is located at the lock position; and a second drum pressing member configured to press the second support portion toward the second positioning plate in a state where the drum unit is attached to the drawer and the lock member is located at the lock position.

30. The image forming apparatus according to claim 28, wherein the lock member has:

a first hole in which the first support portion fits in a state where the drum unit is attached to the drawer and the lock member is located at the lock position; and a second hole in which the second support portion fits in a state where the drum unit is attached to the drawer and the lock member is located at the lock position.

31. The image forming apparatus according to claim 19, wherein the drum unit further includes a waste toner pipe allowing passage of waste toner from the first photosensitive drum and waste toner from the second photosensitive drum; and wherein the drum side plate supports the waste toner pipe.

32. The image forming apparatus according to claim 31, wherein the first frame includes:

a first waste-toner storage portion configured to store waste toner from the first photosensitive drum;

a first discharge portion having a first discharge port for discharging waste toner in the first waste-toner storage portion;

wherein the second frame includes:

a second waste-toner storage portion configured to store waste toner from the second photosensitive drum; and a second discharge portion having a second discharge port for discharging waste toner in the second waste-toner storage portion;

wherein the waste toner pipe has:

a first reception port configured to receive waste toner discharged from the first discharge port; and a second reception port configured to receive waste toner discharged from the second discharge port; and wherein the drum unit includes:

a first seal member having a through hole in communication with the first discharge port and the first reception port, the first seal member sealing between the first frame and the waste toner pipe; and a second seal member having a through hole in communication with the second discharge port and the second reception port, the second seal member sealing between the second frame and the waste toner pipe.

33. The image forming apparatus according to claim 32, wherein the drum unit includes:

a first conveyance member located in the first waste-toner storage portion and configured to convey waste toner in the first waste-toner storage portion toward the first discharge port; and a second conveyance member located in the second waste-toner storage portion and configured to convey waste toner in the second waste-toner storage portion toward the second discharge port.

34. The image forming apparatus according to claim 18, wherein the main housing includes a first positioning portion configured to position one end of the drawer in a movement direction in a state where the drawer is located at the accommodated position, the movement direction being a direction in which the drawer moves relative to the main housing; and wherein the drawer includes a first positioned portion that is positioned relative to the first positioning portion in a state where the drawer is located at the accommodated position.

35. The image forming apparatus according to claim 34, wherein the first positioning portion has a cylindrical shape; and wherein the first positioned portion is a cutout in which the first positioning portion fits in a state where the drawer is located at the accommodated position.

36. The image forming apparatus according to claim 34, wherein the main housing includes a second positioning portion configured to position an other end of the drawer in the movement direction of the drawer in a state where the drawer is located at the accommodated position; and wherein the drawer includes a second positioned portion that is positioned relative to the second positioning portion in a state where the drawer is located at the accommodated position.

37. The image forming apparatus according to claim 36, wherein the second positioned portion has a cylindrical shape; and wherein the second positioning portion is a cutout in which the second positioned portion fits in a state where the drawer is located at the accommodated position.

* * * * *